US007613406B2

(12) United States Patent
Takeda

(10) Patent No.: US 7,613,406 B2
(45) Date of Patent: Nov. 3, 2009

(54) IMAGE FORMING APPARATUS THAT DETECTS A PRESENCE OF A CONDUCTIVE FOREIGN OBJECT ON A RECORDING MATERIAL

(75) Inventor: Masami Takeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 323 days.

(21) Appl. No.: 11/406,251

(22) Filed: Apr. 19, 2006

(65) Prior Publication Data

US 2006/0245768 A1 Nov. 2, 2006

(30) Foreign Application Priority Data

Apr. 28, 2005 (JP) ..... 2005-132311
Sep. 1, 2005 (JP) ..... 2005-253932

(51) Int. Cl.
*G03G 15/00* (2006.01)

(52) U.S. Cl. ..... 399/16

(58) Field of Classification Search ..... 399/16, 399/45

See application file for complete search history.

(56) References Cited

U.S. PATENT DOCUMENTS

| | | | | |
|---|---|---|---|---|
| 5,087,027 | A * | 2/1992 | Acquaviva | 271/258.04 |
| 5,621,510 | A | 4/1997 | Okuda et al. | 399/338 |
| 5,801,360 | A | 9/1998 | Oba et al. | 219/216 |
| 5,920,757 | A | 7/1999 | Izawa et al. | 399/329 |
| 5,999,784 | A | 12/1999 | Tsukida et al. | 399/297 |
| 6,084,208 | A | 7/2000 | Okuda et al. | 219/216 |
| 6,108,017 | A * | 8/2000 | Katakura et al. | 347/115 |
| 6,125,247 | A | 9/2000 | Tsukida et al. | 399/66 |
| 6,330,407 | B1 | 12/2001 | Tsukida et al. | 399/66 |
| 6,427,062 | B1 * | 7/2002 | Takeuchi | 399/388 |
| 6,920,299 | B2 | 7/2005 | Shimura et al. | 399/121 |
| 2005/0123309 | A1 * | 6/2005 | Coriale et al. | 399/21 |

FOREIGN PATENT DOCUMENTS

| | | | |
|---|---|---|---|
| EP | 1355203 | A2 * | 10/2003 |
| JP | 58202234 | A * | 11/1983 |
| JP | 11119479 | A * | 4/1999 |
| JP | 2005041663 | A * | 2/2005 |
| JP | 2005082296 | A * | 3/2005 |

* cited by examiner

*Primary Examiner*—David M Gray
*Assistant Examiner*—Andrew V Do
(74) *Attorney, Agent, or Firm*—Fitzpatrick, Cella, Harper & Scinto

(57) ABSTRACT

The image forming apparatus includes a conductive member provided in a conveying path of a recording material, a voltage applying device for applying a voltage to the conductive member, a current detecting device for detecting a current flowing in the conductive member when the recording material passes through the conductive member to which a voltage is applied by the voltage applying device, and a judgment device for judging, based on an output from the current detecting device, whether a conductive foreign object is present on the recording material. Thus there is provided an image forming apparatus capable of detecting a foreign object attached to a recording material by a simple method.

3 Claims, 19 Drawing Sheets

IMAGE FORMING APPARATUS THAT DETECTS A PRESENCE OF A CONDUCTIVE FOREIGN OBJECT ON A RECORDING MATERIAL

BACKGROUND OF THE INVENTION

1. Field of the Invention

The present invention relates to an image forming apparatus such as a printer, a copying apparatus or a facsimile apparatus, and more particularly to an image forming apparatus capable of detecting a foreign object attached to a recording material.

2. Related Background Art

Image forming apparatus is generally used for forming an image on a recording material such as a plain paper (transfer paper), a postcard, a cardboard, an envelope or a plastic sheet for an overhead projector, and is represented for example by a printer, a copying apparatus and a facsimile apparatus utilizing an electrophotographic process.

An image forming apparatus constituting a background technology of the present invention is illustrated in FIG. 9. As shown in FIG. 9, the image forming apparatus is equipped with a photosensitive drum 1, serving as an image bearing member and rotated in a direction indicated by an arrow.

The surface of the photosensitive drum 1 is uniformly charged by a charging roller 2, and is then subjected to be exposed as an image by exposure means 11 such as a laser, whereby a latent image is formed on the photosensitive drum 1. Then the latent image is developed with toner 3 in a developing device 8 having a developing roller 5, into a visible toner image.

The toner image on the photosensitive drum 1 is carried, by the rotation thereof, to a transfer nip portion (transfer portion) N formed by a transfer roller 4 and the photosensitive drum 1.

On the other hand, a recording material P for image recording, such as a transfer paper, is conveyed from a sheet feed unit (sheet cassette) 15 to the transfer nip portion N, through feed roller pair 16 and paired conveying rollers 17, 18. Then the recording material P is subjected to a transfer of the toner image on the photosensitive drum 1, while being conveyed by the transfer roller 4 in the transfer nip portion N.

The recording material P, bearing the transferred toner image, is conveyed to a fixing device 24 constituted of a heating rotary member 76 and a pressurizing rotary member 77 which constitute a fixing nip portion H, and is subjected therein to heat and pressure whereby the toner image is fixed onto the recording material.

As explained above, the image forming apparatus, after forming a toner image on a recording material, heats and pressurizes the recording material, bearing the toner image, in a fixing device, thereby achieving fuse fixation of the toner image onto the recording material. For image fixation, there is widely known a fixing device of contact heating type, with satisfactory thermal efficiency and safety.

As the fixing device, there is principally employed a heat roller type fixing device constituted by contacting a heat roller and a pressure roller. The heat roller is provided with a releasing layer on the surface of a cylindrical metallic core and incorporates a halogen heater inside the cylinder, while the pressure roller is generally formed by forming an elastic layer of heat-resistant rubber on a metal core and forming a releasing layer thereon.

Also for an even higher heating efficiency, a film-type heat fixing device is recently proposed and utilized, employing a fixing film and a ceramic heater instead of the heating roller. The fixing film is constituted of a heat-resistance resinous film of a low heat capacity such as of polyimide (PI) and a releasing layer formed thereon, and, in the fixing nip portion, the recording material is heated by contacting a ceramic heater across the fixing film.

In such fixing device, as the recording material is heated while it is pinched and pressed in the fixing nip portion, an eventual foreign object present on the recording material may cause a damage on the components of the fixing device, depending on a size, a hardness and a shape of such foreign object. Particularly in a film-type heat fixing device, utilizing a thin fixing film of a heat-resistant resin of a thickness of 100 μm or less, there may result not only a surfacial damage but also a phenomenon of hole formation in the film itself (hereinafter called "film break"), eventually leading to a defective fixed image or a termination in the function of device itself.

FIGS. 10 and 11 illustrate an example in which such film break is caused when a recording material, including a staple 85, is conveyed.

Referring to FIG. 10, when a recording material P bearing a staple 85 (particularly in case an end of the staple being exposed on the surface) enters the fixing nip portion H, the staple end pierces the surface of the film 78 and is dragged toward the downstream side to form a hole 78*g* in the film 78 as shown in FIG. 11, thereby inducing a local fixation failure and an image perturbation in the subsequent fixed images. Also cracks are generated from such hole in the subsequent use, finally leading to a breakage of the film 78.

In this manner, the presence of foreign object on the recording material has not been much experienced in the past and in the ordinary method of use, but, with recently increased consciousness on economical and environmental issues, documents once prepared and used are not discarded but re-used utilizing the unprinted rear side. Such once-used documents include those bound together with a staple or With a paper clip. Therefore, in case of handling a large amount of documents for such re-use, the user may overlook some of such staples or paper clips and may execute printing operation while the paper still bears such staple or paper clip, thereby leading to a trouble of film breakage.

In the prior image forming apparatus, there is proposed, as a countermeasure against such foreign object present in the recording material, to provide an exclusive metal detector utilizing a magnetic sensor or to utilize a magnet for removing such foreign object.

However such metal detector utilizing a magnetic sensor or such magnet leads to a complication and an increased cost of the apparatus.

SUMMARY OF THE INVENTION

An object of the present invention is to provide an image forming apparatus capable of detecting a foreign object, attached to a recording material, by a simple method.

Another object of the present invention is to provide an image forming apparatus including, a conductive member provided in a conveying path of a recording material, a voltage applying device for applying a voltage to the conductive member, a current detecting device for detecting a current flowing in the conductive member when the recording material passes the conductive member to which the voltage is applied by the voltage applying device and a judgment device for judging whether a conductive foreign object is present on the recording material.

DETAILED DESCRIPTION OF THE PREFERRED EMBODIMENTS

In the following, an image forming apparatus embodying the present invention will be explained with reference to the accompanying drawings.

Embodiment 1

Figure 1:
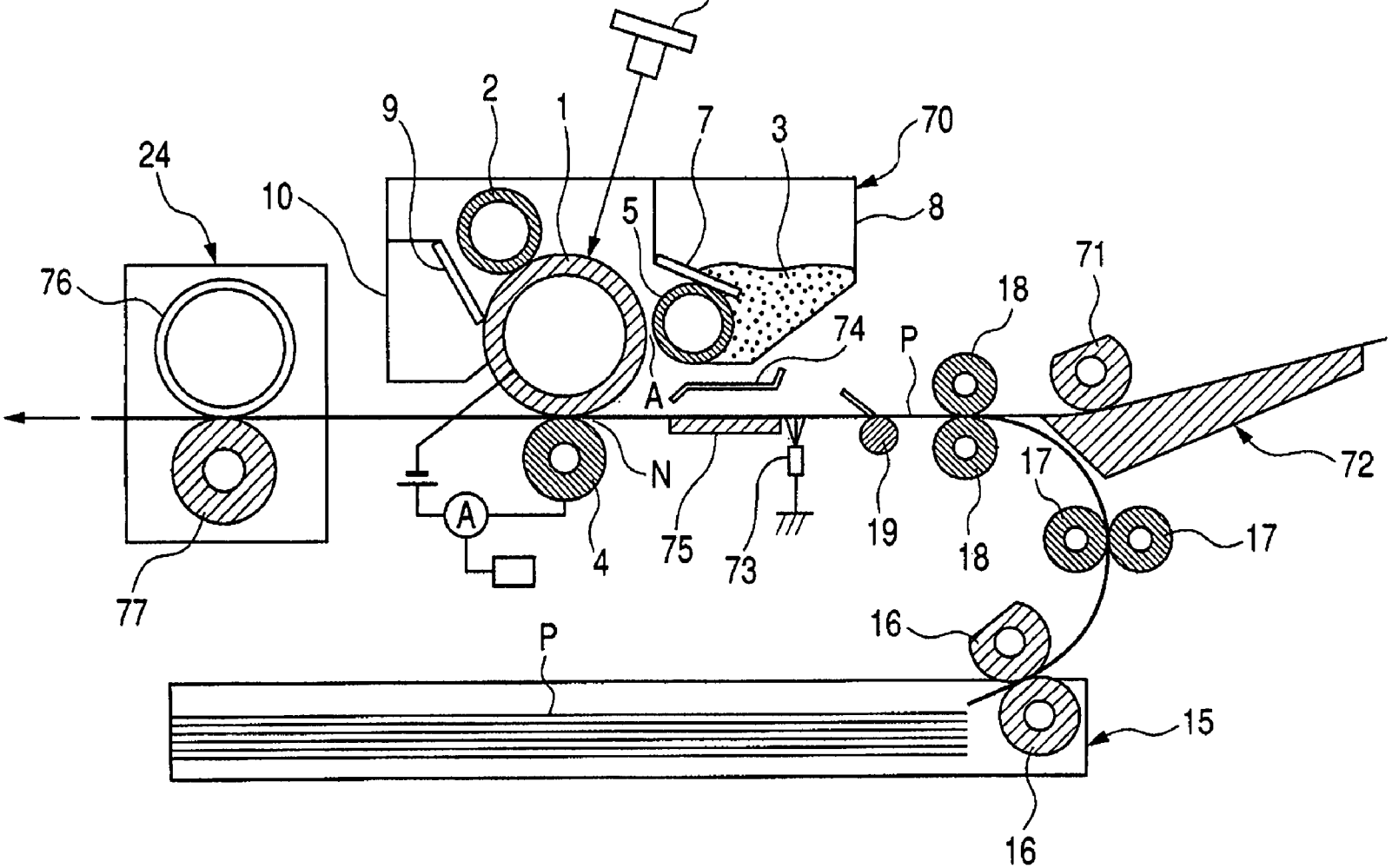
FIG. 1 is a view showing an image forming apparatus constituting an embodiment of the present invention.
Figure 2:
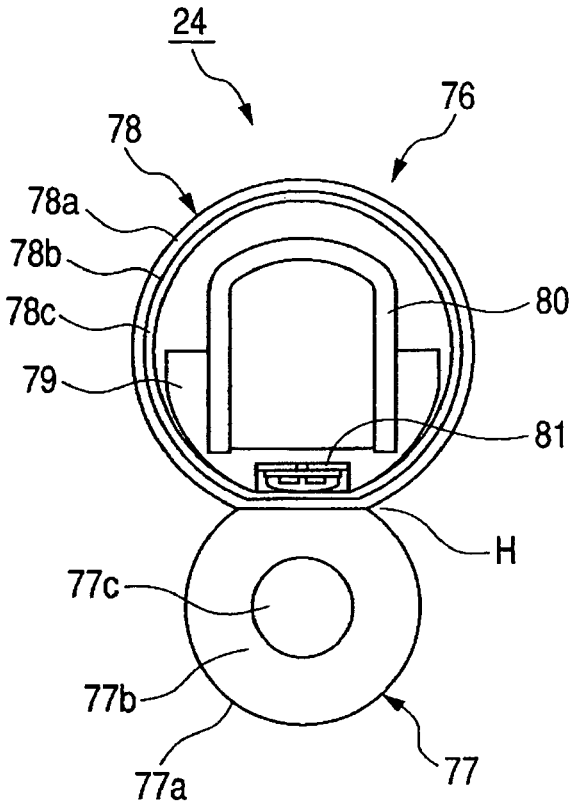
FIG. 2 is a view showing a fixing device of the image forming apparatus.
Figure 3:
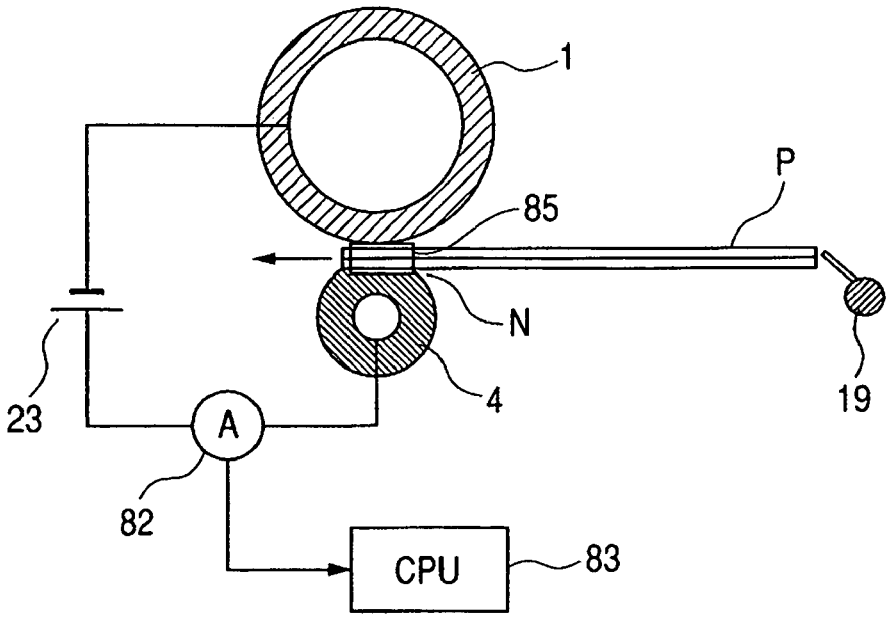
FIG. 3 is a view showing an embodiment in which a foreign object detection in a transfer nip portion.
Figure 4:
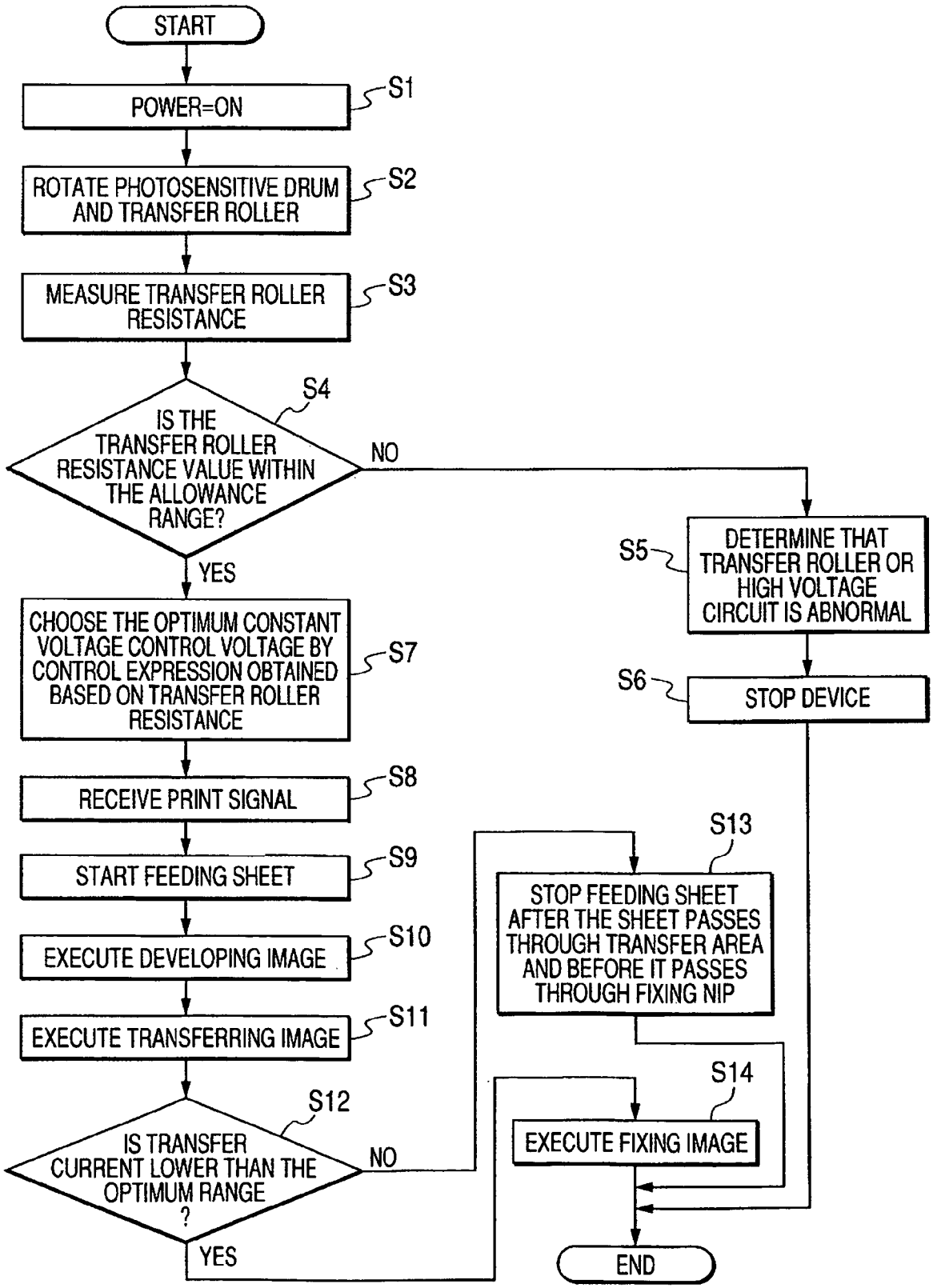
FIG. 4 is a flow chart showing functions of the image forming apparatus.

FIG. 1 is a schematic view showing an image forming apparatus equipped with foreign object detecting means of the present invention, FIG. 2 is a view showing a fixing device of the present embodiment, FIG. 3 is a cross-sectional view showing a transfer step in the image forming apparatus of the present embodiment, and FIG. 4 is a flow chart showing functions of the image forming apparatus, utilizing the foreign object detecting means.

At first referring to FIG. 1, the image forming apparatus of the present embodiment is an electrophotographic printer.

In the printer of the present embodiment, the surface of a photosensitive drum 1 serving as an image bearing member is uniformly charged to a predetermined polarity by a charging roller 2 serving as charging means, and is subjected to an exposure by exposure means 11 such as a laser. Thus the charge is eliminated in thus exposed area, whereby a latent image is formed on the photosensitive drum 1.

The latent image is developed in a developing device 8 equipped with a developing sleeve 5 serving as a developer carrying member for carrying and transporting developer (toner) 3, into a visible toner image.

In more details, the toner 3 carried by the developing sleeve 5 is subjected, between a developing blade 7 serving as a developer layer thickness regulating member and the developing sleeve 5, to a triboelectric charging in a polarity same as that of the charged surface of the photosensitive drum 1. Then, in a developing gap A where the photosensitive drum 1 and the developing sleeve 5 are mutually opposed, a voltage formed by superposing a DC voltage and an AC voltage is applied to induce a floating vibration of the toner 3 by the function of the electric field, whereby the toner is selectively deposited to the latent image area of the photosensitive drum 1. Thereafter, the toner 3 is transported by the rotation of the photosensitive drum 1 to a transfer nip portion N formed by a transfer roller 4 and the photosensitive drum 1.

On the other hand, a recording material P for image recording, such as a transfer paper, is conveyed through either of a path in which the material is conveyed from a sheet cassette 15 by paired feed rollers 16 (lower roller may also be substituted by a pad) until a leading end reaches paired vertical conveying rollers 17 and further conveyed by such paired vertical conveying rollers 17 to paired pre-transfer conveying rollers 18, and a path in which the material is conveyed from a manual-feed tray 72 by a feed roller 71 to the paired pre-transfer conveying rollers 18.

Then, the recording material P is further conveyed by the paired pre-transfer conveying rollers 18, with a predetermined entry angle and along a gap between an upper transfer guide plate 74 and a lower transfer guide plate 75, to the transfer nip portion N where the transfer roller 4 is in contact with the photosensitive drum 1.

In the conveying path for the recording material P from the pre-transfer conveying rollers 18 to the transfer nip portion N, a registration sensor 19 is provided for determining a timing of initiating a latent image formation on the photosensitive drum 1.

The registration sensor 19 is detection means for detecting a timing at which the leading end of the recording material P passes, and is constituted for example of a detecting arm and a photointerruptor.

At the downstream side thereof, a charge eliminating brush 73 is so provided as to be in contact with the rear side of the recording material P under conveying, and is grounded. The recording material P, before reaching the area of the charge eliminating brush 73, has contacted with various members and may have been charged by a friction therewith, and such charge may perturb the image in an electrostatic image formation. Therefore, the charge eliminating brush 73 serves to remove such unnecessary charge.

In the transfer nip portion N, in order to electrostatically attract the toner 3 on the photosensitive drum 1 and to cause it to move toward the recording material P, a high voltage of a polarity opposite to that of the toner 3 is applied to the transfer roller 4 positioned behind the recording material P, whereby the toner 3 is electrostatically attracted and transferred to the recording material P. At the same time, the rear surface of the recording material P is charged to a polarity opposite to that of the toner 3, whereby a transfer charge, for retaining the transferred toner 3, is given to the rear surface of the recording material P.

The recording material P, bearing the transferred toner 3, is conveyed by being pinched between the transfer roller 4 and the photosensitive drum 1, to a fixing device 24 constituted of a heating rotary member 76 and a pressurizing rotary member 77, both constituting a fixing nip portion H. The fixing nip portion H is temperature controlled by a heater provided in the heating rotary member 76 so as to maintain a preset fixing temperature, and the recording material P is heated and pressurized in the fixing nip portion H whereby the toner image is fixed onto the recording material. The fixing device is an image forming device, which forms a toner image on the recording material.

The fixing device 24 of the present embodiment will be explained with reference to FIG. 2, which illustrates an example of a film type heat fixing device.

The film type heat fixing device 24 is equipped with the heating rotary member 76 and the pressurizing rotary member 77. In the fixing device 24 of the present embodiment, the heating rotary member 76 is equipped with a fixing film 78, which is rendered rotatable along a film guide 79 provided at the inside, and is pressed to the pressure roller 77 by a pressure of a pressurizing stay 80 that can be arbitrarily pressed or released from the pressed state. The fixing film is formed by a heat-resistant film of a thickness not exceeding 100 μm.

The fixing film 78 includes a PI (polyimide) substrate layer 78*c*, a conductive layer 78*b* for stabilizing the potential, and a surface releasing layer 78*a*, and a ceramic heater 81 is provided at the internal side of the film in the fixing nip portion H. Also the pressure roller 77 is provided with a metal core 77*c*, a silicone rubber layer 77*b*, and a surface releasing layer 77*a*. The fixing film 78 is rotated by a driving power from the pressure roller 77.

Also a film type heat fixing device of an even higher heating efficiency, utilizing, instead of a fixing film of low heat capacity for example of PI, a fixing film formed by extending a metal such as stainless steel into a thin endless film and forming a releasing layer thereon, is also applicable to the present embodiment.

As the surface of the photosensitive drum 1 after the toner image transfer still bears a small amount of deposits such as toner of different polarity, the surface of the photosensitive drum 1 after passing the transfer nip portion N is subjected to a scraping of the deposits by a cleaning blade 9 which is provided in a cleaning device 10 and is counter contacted with the surface of the photosensitive drum 1. After the cleaning, the photosensitive drum 1 stands by for a next image formation.

In the present embodiment, the charging roller 2, photosensitive drum 1, developing device 8 and cleaning device 10 are constructed as an integral cartridge 70, which is detachably mounted in the main body of the image forming apparatus.

The present invention employs electrical resistance detecting means as detection means for a conductive foreign object attached to the recording material P. In particular, the present embodiment utilizes a transfer process step portion, constituted of the photosensitive drum 1 and the transfer roller 4 which are basic constituents in the electrophotographic image forming apparatus, and employs, for detecting the foreign object, transfer current detecting means which detects a current flowing in the transfer roller 4 by current detection means. The transfer roller 4 is a conductive member, provided in the conveying path of the recording material. Therefore, the foreign object detection can be realized most inexpensively without requiring to add a new component. As will be apparent from FIG. 1, the transfer roller 4 is provided in the upstream side of the fixing device, with respect to the conveying direction of the recording material.

Now, the transfer portion in the present embodiment will be explained in further details with reference to FIG. 3.

In the present embodiment, the transfer roller 4 constituting the transfer portion is formed by a conductive elastic roller, having a medium resistance elastic layer of which volume resistivity is regulated at $1\times10^{6}$-$1\times10^{10}$ Ω·cm. Such transfer roller 4 is maintained in contact with the photosensitive drum 1, and, while recording material P is conveyed in the transfer nip portion N formed by a contact nip of the photosensitive drum 1 and the transfer roller 4, a transfer voltage is applied by a high-voltage source 23 to the transfer roller 4, thereby providing the recording material P with a charge of a polarity opposite to that of the toner image, and thus transferring the toner image on the photosensitive drum 1 onto the recording material P.

The transfer roller 4 has an elastic layer, of which electrical resistance is suitably regulated by dispersing inorganic conductive particles such as carbon in rubber or sponge, or by employing ionic conductive rubber blended for example with a surfactant. The resistance of such transfer roller may change by a digit or more, for example by a resistance change resulting from a fluctuation in the manufacture, by temperature and humidity or by a prolonged use.

In order to constantly give an optimum current in the transfer roller showing such resistance change, it is conceivable to apply the transfer voltage to the transfer roller 4 by a "constant current supply method".

In such case, however, when a small-sized recording material narrower than a maximum sheet-passing width of the apparatus is used, a sheet non-passing area where the transfer roller comes into direct contact with the photosensitive drum increases in the longitudinal direction of the transfer nip portion N, and the current is concentrated in such area to result in a deficient current supply to the recording material P, thereby inducing a transfer failure.

For this reason, most image forming apparatuses employ a "constant voltage supply method", in order to obtain an appropriate current regardless of the size of the recording material. In such constant voltage supply method, in order to provide an appropriate current in consideration of the resistance of the transfer roller, fluctuating by manufacturing conditions and environmental conditions, an impedance of the transfer system before sheet passing is detected for example by a voltage control method (active transfer voltage control (ATVC) method) in which a constant current to be supplied to the transfer roller at the sheet passing is supplied to the transfer roller prior to the sheet passing to obtain a resulting voltage which is retained and applied at the transfer operation, or a voltage control method (a programmable transfer voltage control (PTVC) method) in which a constant current is supplied to the transfer roller prior to the sheet passing, and a resulting voltage is used in a predetermined calculation formula for calculating a voltage to be applied at the transfer operation, and thus there is applied a transfer voltage capable of obtaining a current within an appropriate range.

In comparison with the ATVC method requiring an exclusive circuit and only capable of providing several applicable voltages, the PTVC method is capable of more precise voltage control and is also advantageous in cost as it does not require an exclusive voltage controlling circuit.

In the PTVC method, in more detail, while the photosensitive drum is charged in a sheet non-passing state before the printing operation, a voltage is applied to the transfer roller by stepwise increasing a PWM (pulse width modulated) signal toward a target current, and a voltage providing the target current is held as Vt0. A transfer voltage Vt matching the Vt0 is determined from such Vt0 and a transfer output table or a control formula, stored in advance in a CPU of the control circuit (more specifically by judging the resistance of the transfer roller from the target current and Vt0, and obtaining a transfer voltage Vt providing an optimum image quality for the transfer roller of such resistance by a selection from the transfer output table stored in advance in the apparatus or by a calculation based on the control formula), and, in the printing operation, a PWM signal corresponding to such transfer voltage Vt is outputted to apply the voltage Vt to the transfer roller.

Such transfer control method allows, by determining the transfer voltage Vt at the printing operation based on the voltage Vt0 generated by each transfer roller under a given current, to apply an optimum voltage corresponding to the resistance of each transfer roller, thereby enabling to obtain satisfactory images with transfer rollers having widely varying resistance.

The present embodiment is featured in utilizing the transfer current detection means, employed in such transfer control, for detecting a metallic foreign object present on the recording material.

In the present embodiment, there will be contemplated a case, as illustrated in FIG. 3 in a cross-sectional view of the photosensitive drum 1 and the transfer roller 4 constituting the transfer nip portion N, where a recording material P bearing a metallic foreign object 85 such as a stable or a clip enters the transfer nip portion formed in a contact area of the photosensitive drum 1 of which surface is charged at negative potentials of about −100 to −600 V according to an image pattern, and the transfer roller 4 which is given a high voltage by a transfer voltage applying circuit (voltage application means) 23 capable of applying a voltage up to about +6 kV.

Also following resistance ranges are assumed for the components:

(1) volume resistivity of metallic foreign object: 10 Ω·cm or less;

(2) volume resistivity of recording material: $10^{11}$-$10^{14}$ Ω·cm;

(3) volume resistivity of recording material: $10^{6}$-$10^{10}$ Ω·cm.

In the system having such magnitudes of resistances, a current detecting device 82 provided in the transfer voltage applying circuit detects a maximum current flowing between the transfer roller and the photosensitive drum 1 while the recording material P is pinched therebetween, then the result of detection is compared with a reference threshold value, stored in advance in a CPU 83, and, in case the current exceeds the threshold value, presence of a foreign object is identified and the conveying operation of the recording material P is immediately interrupted. The CPU is provided with a judgment device for judging whether the recording material has a conductive foreign object, based on the output from the current detecting device.

In such state, the transfer current depends on a charge amount that the recording material P, which is substantially insulating in an ordinary environment, receives per unit time from the transfer roller 4 at a rate relating to the nip area and the conveying speed. On the other hand, the metallic foreign object 85 such as a paper clip or a staple only generates an instantaneous current change because it has a very small contact area with the transfer roller 4 or the photosensitive drum 1 because it moves at a high speed. Therefore, the threshold value in the transfer current, constituting a basis for judgment, cannot be simply calculated from the resistances of the components but depends on the performance and structure of the apparatus and also on environmental conditions such as temperature and humidity.

In the present embodiment, in an evaluation with an apparatus capable of printing 45 sheets per minute with a conveying speed of the recording material P of 266 mm/sec under temperature/humidity condition of 23° C./50%, the transfer current was 15 μA in average in the absence of the metallic foreign object but showed an increase to 22 μA or higher when a staple or a paper clip was attached to the recording material. Therefore, the conveying of the recording material P is interrupted upon detecting, as a threshold value, a current of 1.5 times or larger of the normal transfer current, thereby preventing entry of the metallic foreign object 85 into the fixing nip portion H.

As explained in the foregoing, the present embodiment utilizes electrical resistance detecting means which applies a voltage between two members and detects a current between the two members while the recording material therebetween thereby detecting the conductive foreign object. In particular the present embodiment utilizes the transfer current detecting means for the purpose of foreign object detection, and can achieve the foreign object detection by a very simple structure. Also such foreign object detection means utilizes, for the foreign object detection, components for image formation on the recording material, such as the photosensitive drum 1, the transfer roller 4 prepared with a conductive material which has a lower electrical resistance than in the recording material P and a higher electrical resistance than in the foreign object, the voltage applying means 23 which applies a predetermined voltage to the transfer roller 4 and the current detecting means 82 which detects a current flowing in the transfer roller 4, and does not require any new component for the detection, whereby the structure of the apparatus can be simplified.

FIG. 4 is a flow chart of an image forming process, incorporating the detection and control explained above. The image forming process is executed in the following manner.

When the power supply of the apparatus is turned on, the resistance of the transfer roller 4 is measured while the photosensitive drum 1 and the transfer roller 4 are rotated (S1-S3).

In case the resistance is not within a usable range, an abnormal status is identified to suspend the operation of the apparatus, whereupon the image formation is terminated (S4-S6).

In case the resistance is within the usable range, an optimum transfer voltage, matching the resistance of the transfer roller, is selected and memorized until an actual application timing of the transfer voltage (S4, S7).

In the path of the recording material to the transfer step portion, the registration sensor 19 is provided as leading end pass-through timing detection means (leading end detecting device) for detecting the leading end of the recording material. The leading end detecting device 19 is provided at the upstream side of the transfer roller with respect to the conveying direction of the recording material. The timing of application of the transfer voltage is determined, after the feeding of the recording material is started in response to a print signal, together with the timing of application of the developing bias voltage, by informing the CPU of a time when the leading end of the recording material passes the position of the registration sensor 19. However, in case a high transfer voltage is applied in a state where the recording material is absent in the transfer nip portion, an unnecessary charging may be induced on the opposed surface of the photosensitive drum, thereby perturbing the next image formation. For this reason, as regards such timing of application of the transfer voltage, the voltage is preferably applied after the leading end portion of the recording material sufficiently enters the transfer nip portion in consideration of such charging hysteresis.

On the other hand, the present embodiment assumes that the metallic foreign object 85 is attached to a leading end portion of the recording material, so that, if the timing of application of the transfer voltage is excessively distanced from the leading end of the recording material, a detection failure may result for a short foreign object such as a staple attached close to the leading end of the recording material.

Therefore, in the present embodiment the timing of application of the transfer voltage is regulated as close as possible to the leading end of the recording material, in such a manner that the transfer voltage is applied within 2 mm at maximum from the leading end (S8-S11).

In case an abnormal change in the transfer current is detected in the course of transfer (in the present embodiment, upon detection of a current of 1.5 times or larger of the ordinary transfer current), the presence of a foreign object is detected and the conveying of the recording material is interrupted at a timing before the entry of such foreign object into the fixing nip portion, thereby terminating the image formation (S12, S13).

In a case where the absence of the foreign object is detected, the recording material P is advanced to the fixing nip portion, whereby completing the image formation (S12, S14).

Even in case the apparatus has such a response speed capable of detecting the foreign object in the transfer nip and instantaneously interrupting the conveying of the recording material while it is still in the nip portion, the conveying is preferably interrupted after the foreign object passes through the nip portion, in order to avoid a danger of damaging the surface of the photosensitive drum or the transfer roller by an external force that may be applied during a subsequent jam removing process.

In the above-described embodiment, the transfer roller 4 serving as a contact transfer member is formed by a rubber roller, constituted of a metal core of iron or stainless steel, and thereon a medium resistance elastic layer of a solid or foamed rubber material, such as EPDM, silicone rubber, NBR or urethane rubber. The transfer roller has a hardness of 25-70° (Asker C hardness under a total load of 9.8 N (1 kg)), and the elastic layer is formed by a primary vulcanization and a secondary vulcanization, followed by a surface polishing to an external shape of a desired dimension.

In the PTVC method of the present embodiment, in more details, the CPU controlling the transfer voltage outputs a PWM signal having a pulse width corresponding to the desired transfer output voltage from an OUT port. A transfer output table (not shown) corresponding to the pulse width is memorized in the CPU, and the PWM signal is formed as a DC signal by a low-pass filter (not shown) and amplified by an amplifier (not shown) to provide a transfer output voltage Vt. A signal corresponding to an induced current It is supplied to an IN port of the CPU and is detected therein.

The current It in the transfer roller is judged by detecting a current in the transfer high-voltage source 23 with the current detection circuit 82 and by entering a digital converted value obtained by an unillustrated A/D converter (hereinafter represented as "transfer AD value") into the CPU.

In the PTVC method, a voltage, obtained by having gradually elevated the output voltage from the transfer high-voltage source 23 until the transfer current has reached a predetermined current, is memorized as Vt0, and, based on the result of detection, a first target transfer voltage Vt1 to be applied at the transfer operation is determined according to a transfer control formula (1) stored in the CPU:

$$Vt1=\alpha Vt0+\beta \quad (1)$$

wherein:

Vt0: voltage generated when a predetermined detection current is supplied to the transfer roller in PTVC process;

$\alpha,\beta$: constants selected in advance for the transfer system.

After the determination of Vt1 and when the preparations for image formation are completed, a printing operation is initiated and a recording material is fed to the transfer nip portion in synchronization with a toner image on the photosensitive drum.

The present embodiment utilizes the current detecting circuit for detecting the metallic foreign object of a low resistance on the recording material and such current detecting circuit also detects the resistance of the recording material in the course of the transfer step, but, in case the recording material has such a high conveying speed as to provide a current change in an extremely short period, it is also possible to separately provide a peak-hold circuit, through which the output signal of the current detecting circuit is supplied to the CPU.

Embodiment 2

Figure 5:
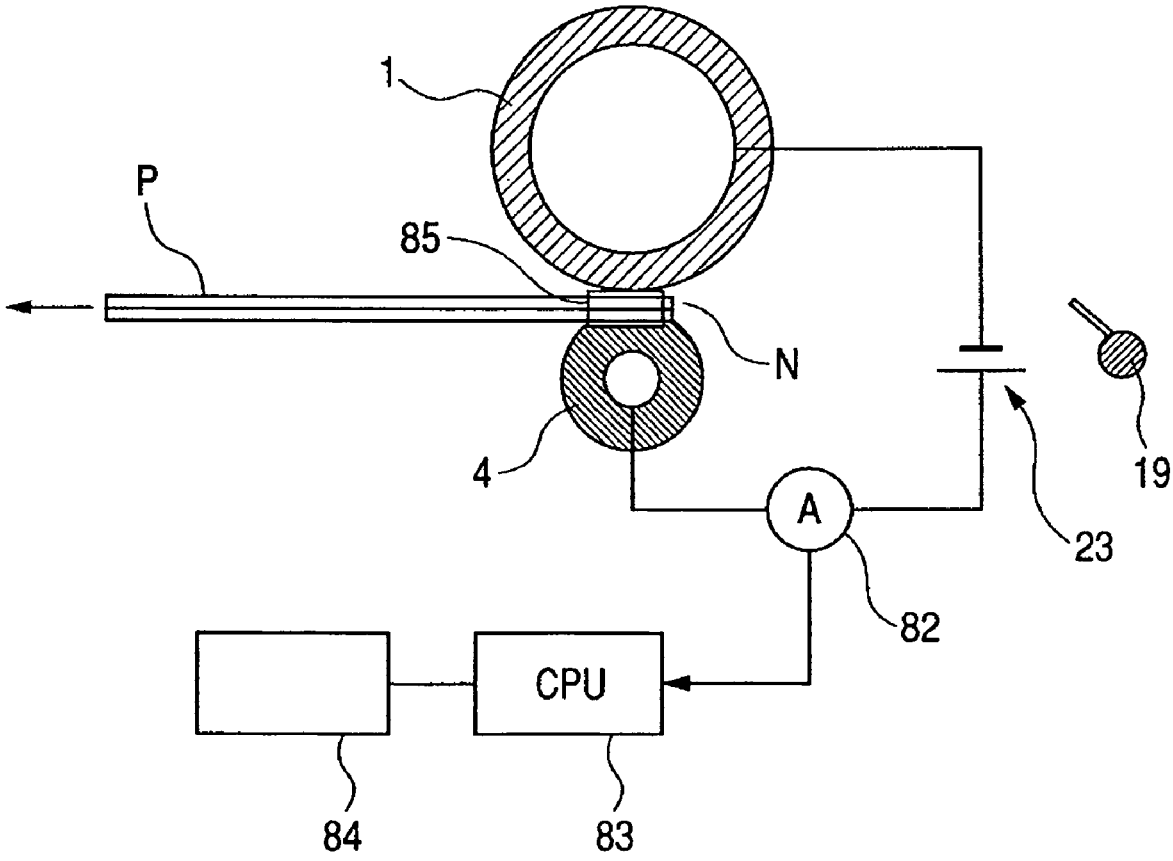
FIG. 5 is a view showing an embodiment in which a foreign object detection is executed in a transfer nip portion.
Figure 6:
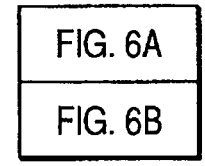
FIG. 6 is comprised of FIGS. 6A and 6B are flow charts showing functions of the image forming apparatus.
Figure 6A:
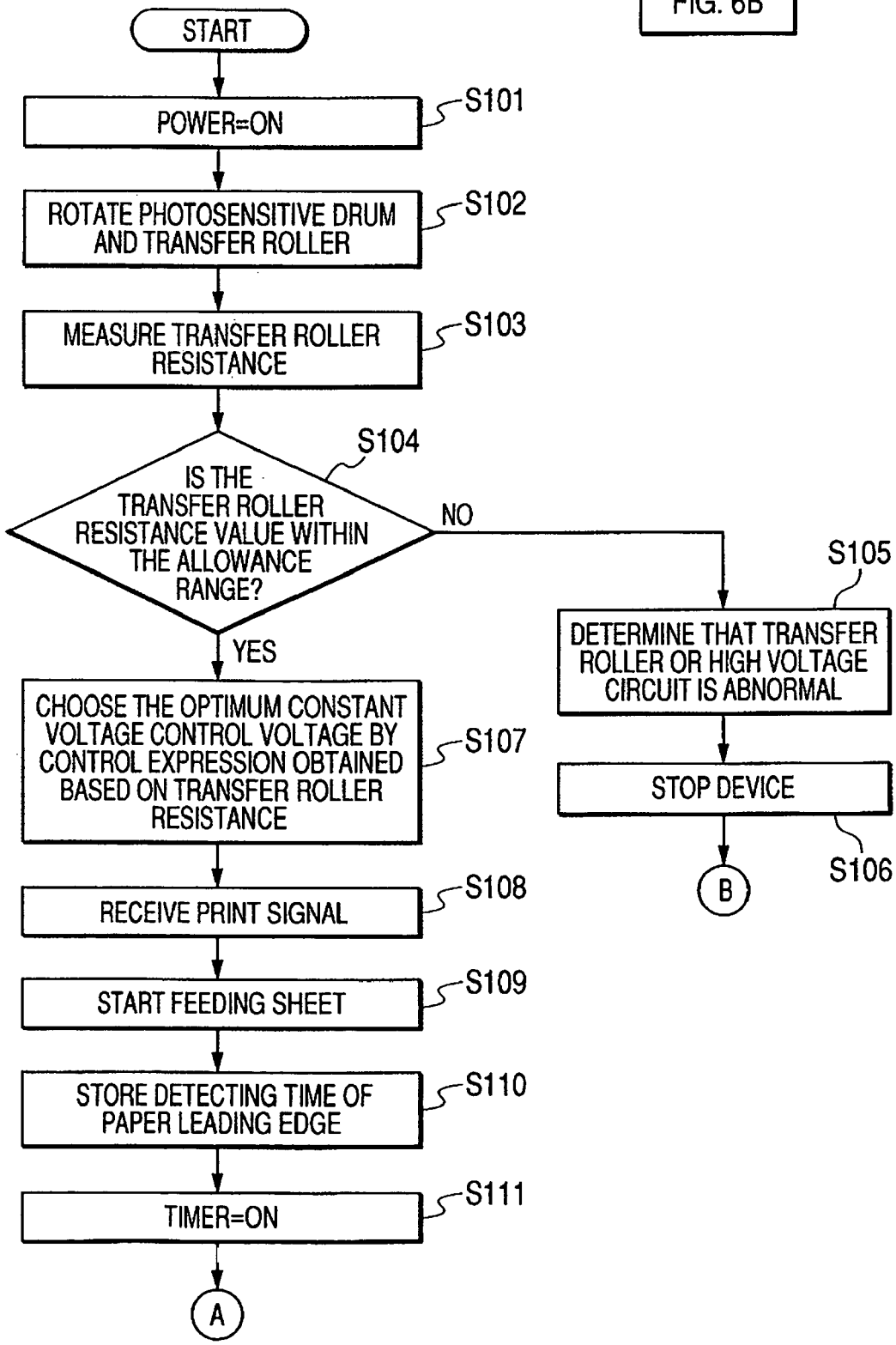
Figure 6B:
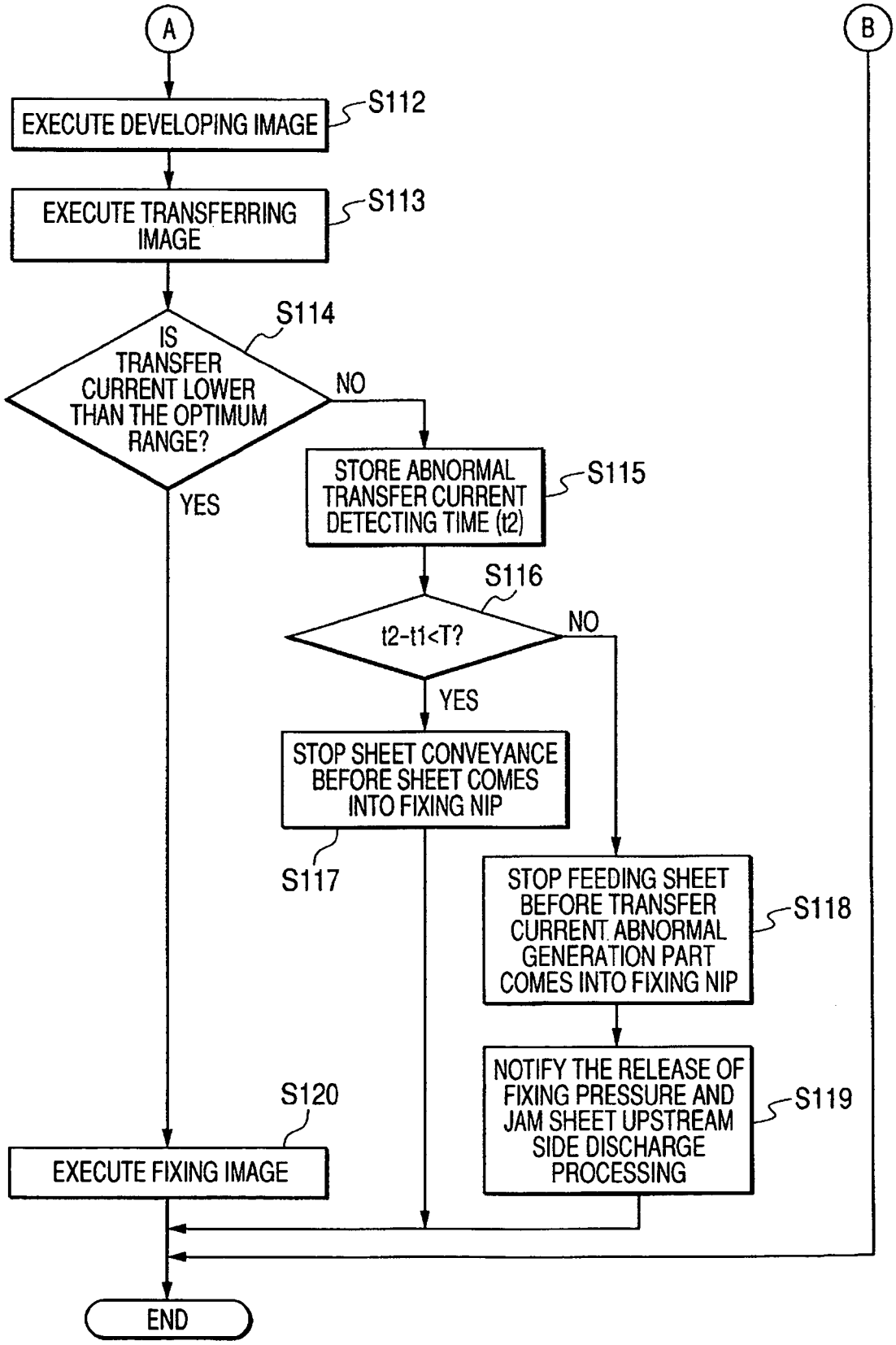

In the following, there will be explained a second embodiment of an image forming apparatus equipped with foreign object detecting means of the present invention. FIG. 5 is a cross sectional view showing a transfer step of the image forming apparatus of the present embodiment, and FIGS. 6A and 6B are flow charts showing functions of the image forming apparatus utilizing, as in Embodiment 1, foreign object detecting means by electric resistance detection (namely transfer current detecting means). The image forming apparatus of the present embodiment is basically same, in constitution, as that of Embodiment 1, so that the following description will be given on different portions. Also in the present embodiment, components equivalent in constitution and function to those in Embodiment 1 will be represented by like reference numbers and will not be explained in detail.

The present embodiment utilizes, for detecting a conductive foreign object attached to the recording material P, a transfer step portion constituted of the photosensitive drum 1 and the transfer roller 4 as in Embodiment 1, thus achieving foreign object detection most inexpensively without requiring any new component.

The present embodiment is featured, in comparison with Embodiment 1 which merely stops the apparatus upon detecting a metallic foreign object, by having a function of instructing a method of processing the stopped recording material P depending on the attached position of the foreign object 85 on the recording material P.

In setting a recording material P in an inverted state in the image forming apparatus in order to utilize a rear side of once printed recording material P, such setting is not always executed under clear confirmation of the positions of leading and trailing ends of the recording material P, but may rather be set in a state where the leading and trailing ends are randomly positioned, in order to print data irrelevant from the data printed before on the front surface.

In such situation, when the recording material P is conveyed, as shown in FIG. 5, with a metallic foreign object 85 attached to a rear end portion in the conveying direction of the recording material the interruption of conveying upon foreign object detection can be executed only after most of the image has been formed on the recording material, and the stopping of the apparatus takes place after the actually detected foreign object 85 passes through the nip and thus after all the transfer step has been completed.

In such case, in recent apparatuses which do not employ another conveying means for conveying the recording material P after the transfer to the fixing device, though somewhat dependent on the size of the apparatus and the distance between the transfer portion and the fixing device, a front half portion or at least a leading end portion of the recording material P already passes through the fixing nip portion H at the completion of the transfer step.

When the foreign object 85 is detected in the leading end portion of the recording material as in Embodiment 1, such recording material P may be removed, after the apparatus is stopped, without difficulty to the upstream side in the conveying direction of the recording material, but when the detection of foreign object takes place in the trailing end portion and the apparatus is stopped in a state where the leading end portion passes and is pinched in the fixing nip H, the user is inclined, without any particular instruction, to extract the recording material, by pulling the leading end portion, now appearing in the exit side of the fixing device, in the discharging direction.

In such situation, though the apparatus is stopped by the detection of the foreign object 85, such manual extracting operation causes the foreign object 85 to pass through the fixing nip H, thereby resulting in the breakage of the fixing film. In fact a stress at such forced manual extraction of the recording material P, pinched in the fixing device stopped in a pressurized state, gives a larger damage to the fixing film in comparison with an ordinary fixing step in which the recording material is conveyed by the rotation of the film and the roller, and the film breakages found in the market are considered to principally occur under such situation.

In consideration of the foregoing, the present embodiment includes a system of instructing a method for processing the recording material with the foreign object attached to the trailing end portion according to flowcharts shown in FIGS. 6A and 6B, which will be explained in the following.

When the power supply of the apparatus is turned on, the resistance of the transfer roller 4 is measured while the photosensitive drum 1 and the transfer roller 4 are rotated (S101-S103).

In case the resistance is not within a usable range, an abnormal status is identified to suspend the operation of the apparatus, whereupon the image formation is terminated (S104-S106).

In case the resistance is within the usable range an optimum transfer voltage, matching the resistance of the transfer roller, is selected and memorized until an actual application timing of the transfer voltage (S104, S107).

After the feeding of the recording material is initiated in response to a print signal, a passing time of the leading end of the recording material through the leading end detecting position of the registration sensor 19 is informed to the CPU, thereby initiating preparations for synchronizing the start timing of image formation, also the passing time t1 is memorized in a memory and a timer is simultaneously activated to measure a period elapsing from t1 (S108-S111).

Then the steps of development and transfer are executed (S112, S113), and, in case an abnormal change in the transfer current is detected in the course of transfer (in the present embodiment, upon detection of a current of 1.5 times or larger of the ordinary transfer current), presence of a foreign object is identified, thus the conveying of the recording material is interrupted at a timing before the entry of such foreign object into the fixing nip portion, and a detection timing t2 of the foreign object is stored in a memory (S114, S115).

Then a comparison is made between (t2−t1), obtained by a calculation or from the timer, and a fixing portion entry time T of the leading end of the recording material, calculated in advance from the distance between the leading end detecting position of the recording material and the entrance of the fixing nip, and from the recording material conveying speed of the apparatus (S116).

In case of (t2−t1)<T, the presence of a foreign object is detected and the apparatus is stopped to interrupt the conveying of the recording material at a timing before the entry of such foreign object into the fixing nip portion as in Embodiment 1, thereby terminating the image formation (S117).

In case of (t2−t1)≧T, the leading end of the recording material has already entered the fixing nip portion, and, if exposed to the exit side, the recording material may possibly be extracted in the discharging direction. In order to avoid such danger, the CPU 83, after the apparatus is stopped, utilizes informing means 84 (FIG. 5) for example having a display device to provide the user with an error notice and an instruction to remove the recording material by extracting it toward the upstream side in the conveying direction, thereby terminating the image formation (S118-S119).

The heating rotary member 76 and the pressurizing rotary member 77 in the fixing device 24 are normally mutually pressed by the pressurizing stay 80 (FIG. 2). Therefore, it is preferable that the fixing device 24 is equipped with pressurization releasing means (not shown) for releasing the pressurization by the pressurizing stay 80, and the informing means 84 instructs, after releasing the pressurized state of the heating rotary member 76 and the pressurizing rotary member 77 by means of the pressurization releasing means, the removal of the recording material with the foreign object.

In case S14 (FIG. 6) identifies absence of the foreign object, the recording material P is advanced to the fixing nip portion, whereby the image formation is completed (S120).

The above-described constitution allows, even in case a recording material with a foreign object 85 attached to the trailing end portion is subjected to a printing on the rear surface and the leading end portion of the recording material has already passed the fixing nip portion H, to prevent breakage of the fixing film in the fixing portion, since an appropriate jam eliminating process is instructed by the main body of the apparatus.

In the above-explained constitution, the transfer voltage application is terminated at such a timing corresponding to within 2 mm from the trailing end of the recording material, in consideration of a possibility that the metallic foreign object is attached close to the trailing end of the recording material, as in the consideration made for the leading end of the recording material in Embodiment 1.

Embodiment 3

Figure 7:
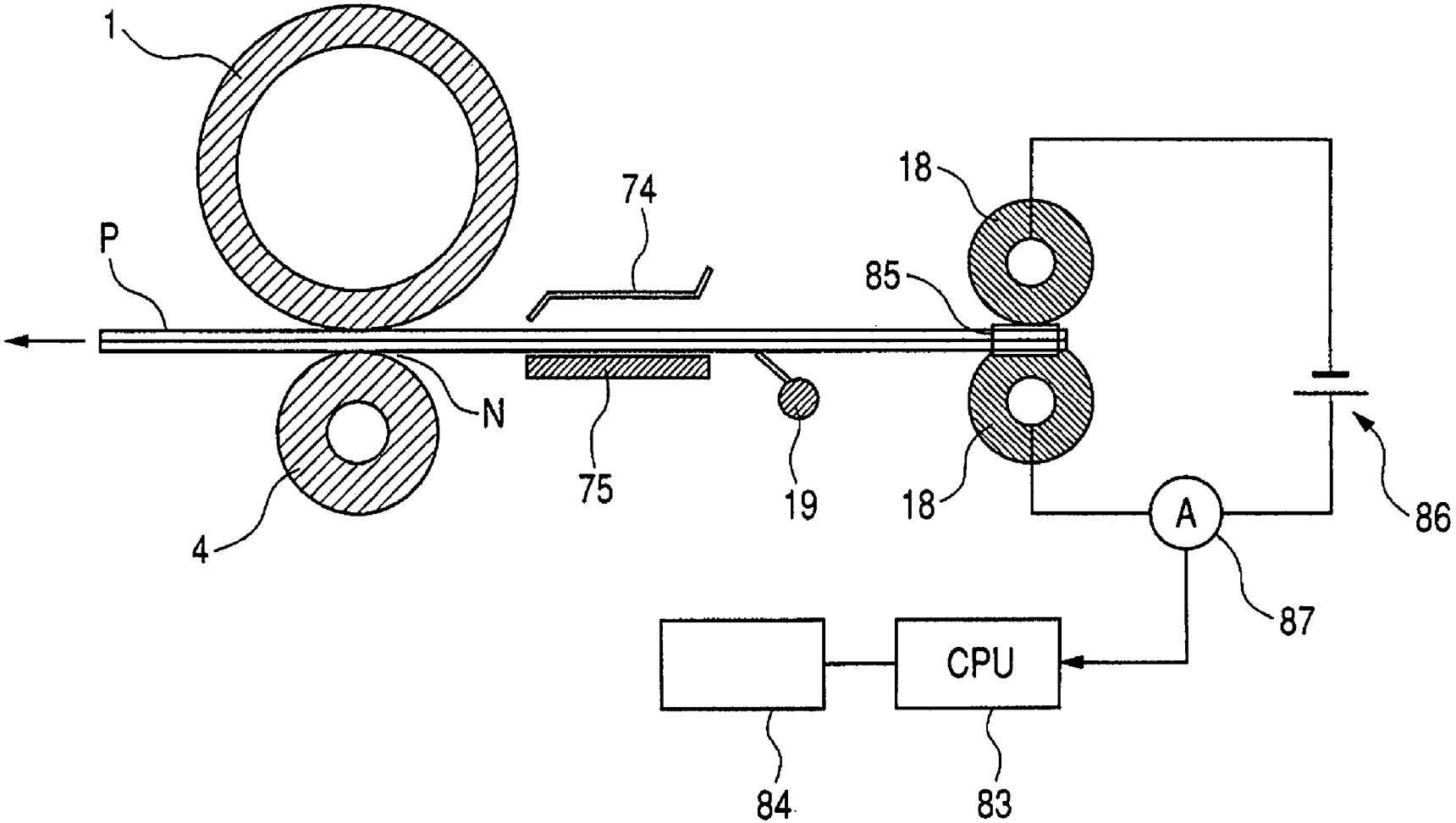
FIG. 7 is a view showing an embodiment in which a foreign object detection is executed in a transfer nip portion.
Figure 8:
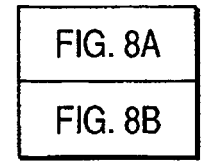
FIG. 8 is comprised of FIGS. 8A and 8B are flow charts showing functions of the image forming apparatus.
Figure 8A:
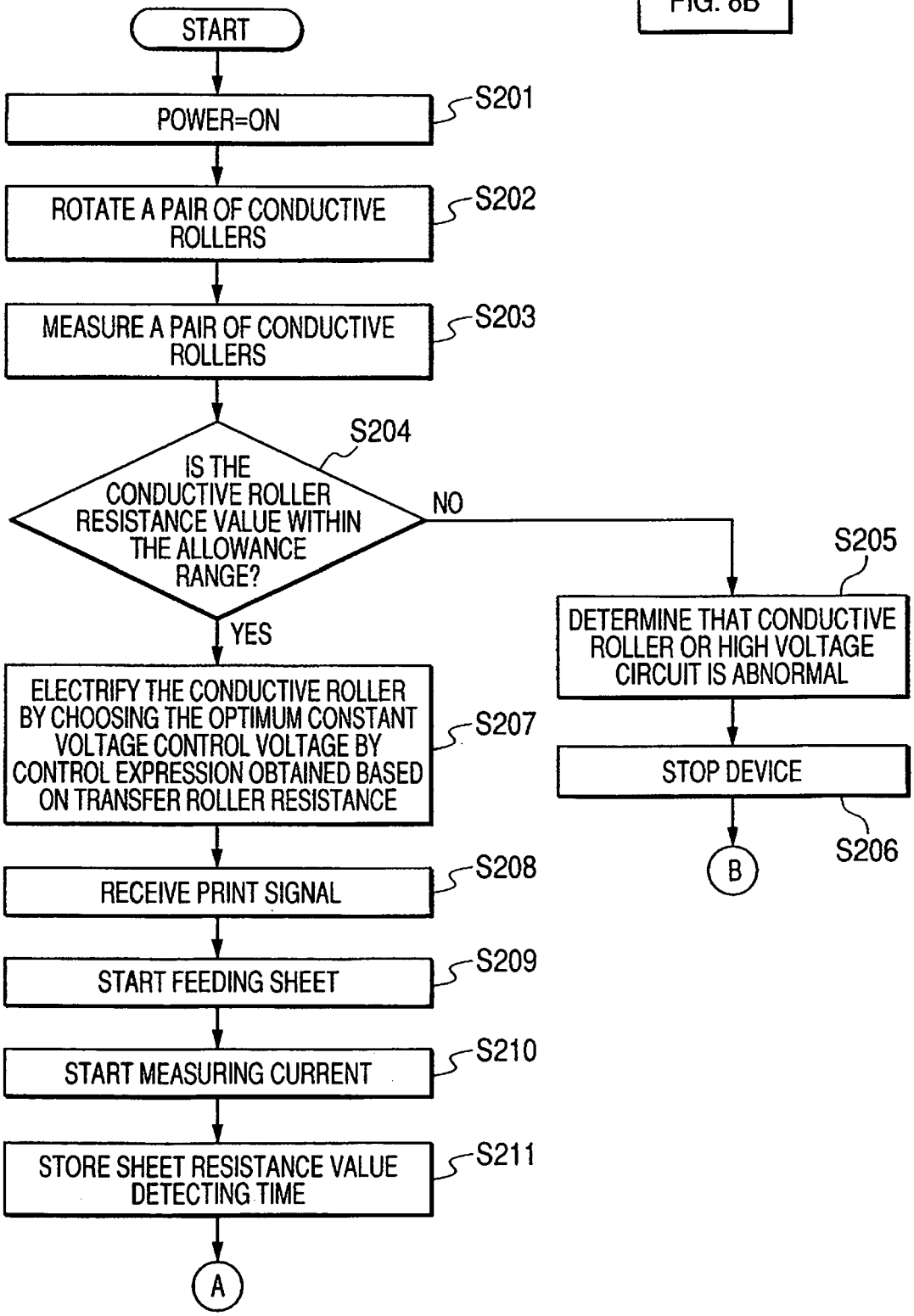
Figure 8B:
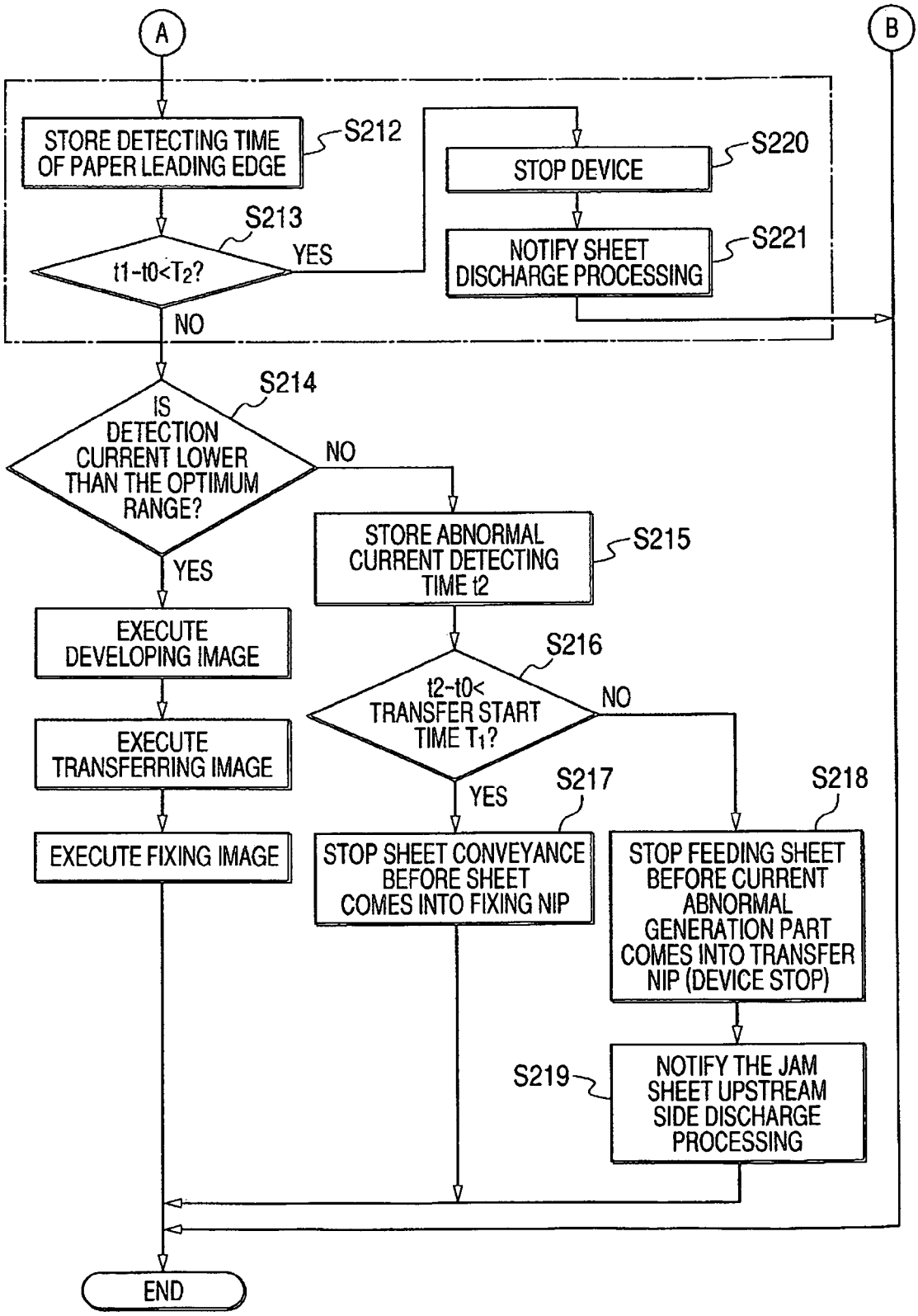
Figure 9:
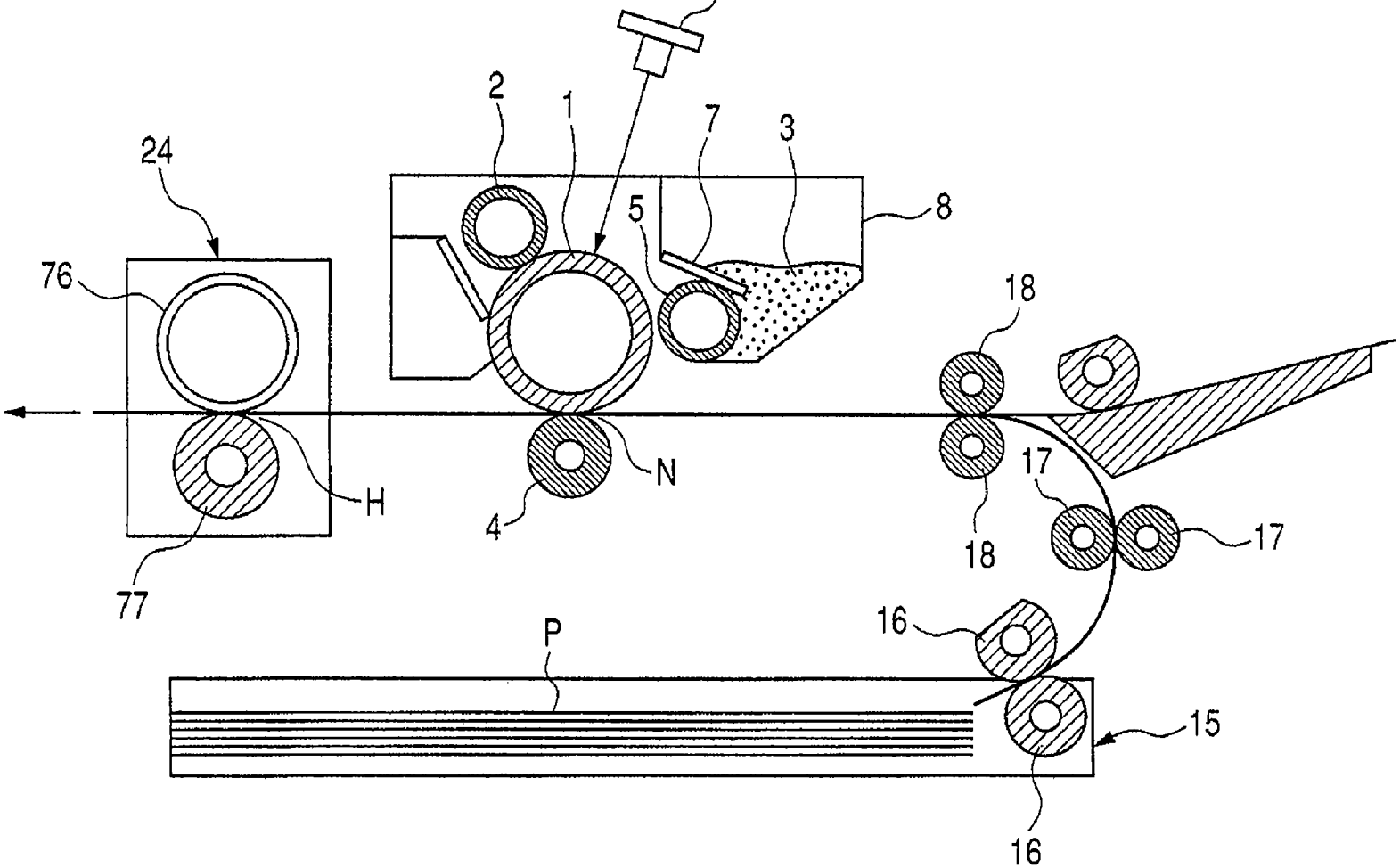
FIG. 9 PRIOR ART
FIG. 9 is a view showing an image forming apparatus, constituting a background technology of the present invention.
Figure 10:
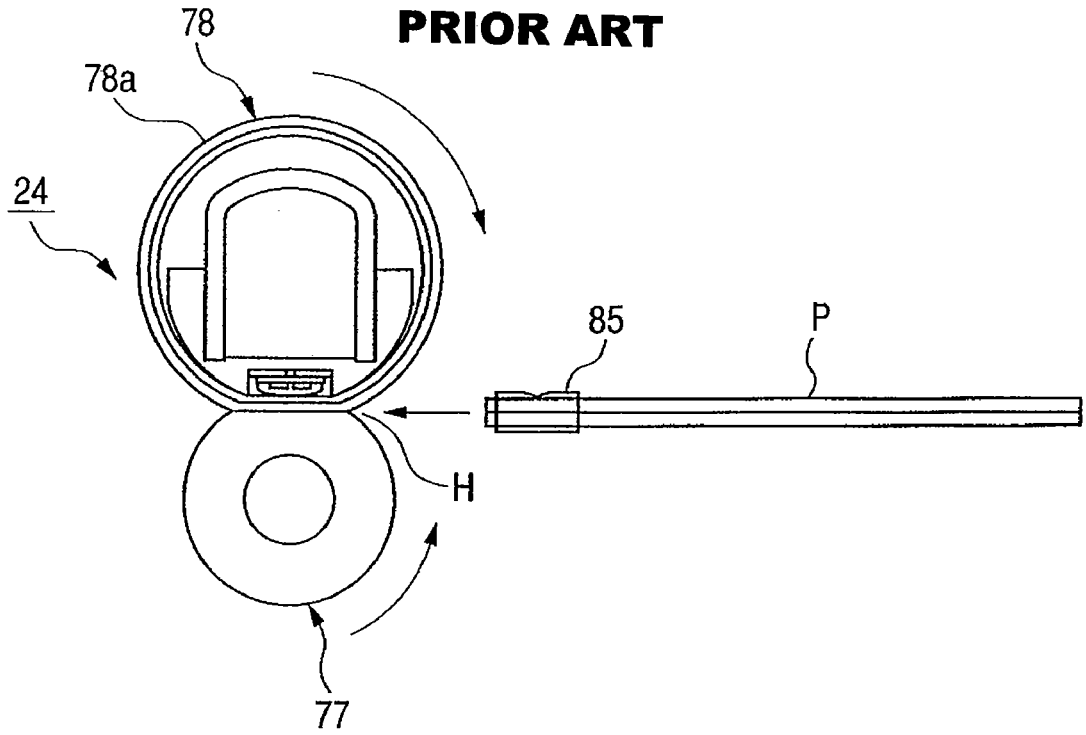
FIG. 10 PRIOR ART
FIG. 10 is a view showing a state of entry of a foreign object into a fixing device in the apparatus shown in FIG. 9.
Figure 11:
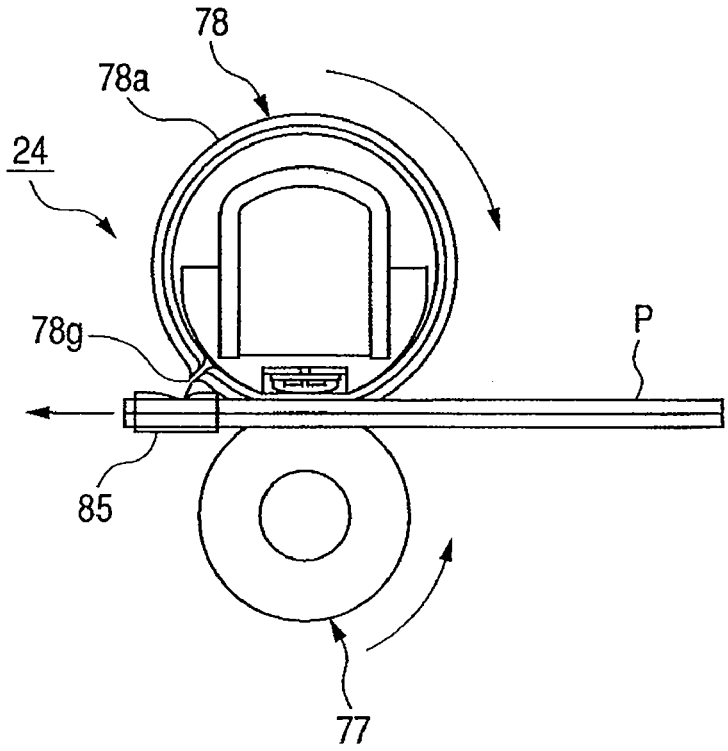
FIG. 11 PRIOR ART
FIG. 11 is a view showing a film damage caused by a foreign object entry into the fixing device in the apparatus shown in FIG. 9.

In the following, there will be explained a third embodiment of the image forming apparatus equipped with foreign object detecting means of the present invention. FIG. 7 is a cross sectional view showing a transfer step of the image forming apparatus of the present embodiment, and FIGS. 8A and 8B are flow charts showing functions of the image forming apparatus utilizing foreign object detecting means by electric resistance detection. The image forming apparatus of the present embodiment is basically same, in constitution, as that of Embodiment 1, so that the following description will be given on different portions. Also in the present embodiment, components equivalent in constitution and function to those in Embodiment 1 will be represented by like reference numbers and will not be explained in detail.

The present embodiment is featured, as means for detecting a conductive foreign object 85 attached to the recording material P, by constituting the paired conveying rollers 18 for the recording material, positioned in the upstream side of the conveying direction thereof, with a pair of conductive rollers of a medium resistance, and by providing voltage applying means 86 for the recording material conveying rollers and current detecting means 87 for the recording material conveying rollers.

More specifically, the foreign object detecting means of the present embodiment is that of current detection type, constituted of the paired recording material conveying rollers, which are conductive conveying means prepared with a conductive material of an electrical resistance lower than that of the recording material P and higher than that of the foreign object, the voltage applying means 86 for applying a predetermined voltage to the conductive conveying means, and the voltage detecting means 87 for detecting a current flowing in the conductive conveying means, designed particularly for detecting the current flowing in the paired recording material conveying rollers.

The paired conveying rollers 18 of the present embodiment are registration rollers. The leading end of the recording material conveyed prior to the image formation impinges on a nip of the paired conveying rollers 18 which are in a temporarily stopped state, whereby the leading end of the recording material is aligned.

In the present embodiment, such paired registration rollers 18 are utilized as foreign object detection means to realize an inexpensive apparatus, and the foreign object detection executed at the position of the registration rollers enables detection on all the recording materials supplied from the cassette or supply manually.

The present embodiment is further featured, in comparison with Embodiments 1 and 2 for preventing entry of the metallic foreign object portion of the recording material into the fixing nip portion H, by a function of preventing entry of the foreign object into the transfer nip portion N of the transfer member which is an image forming device.

In case a recording material P, bearing a foreign object 85 such as a paper clip or a staple, enters the transfer nip portion N, the recording material, being pinched and conveyed by a rigid photosensitive drum 1 and an elastic transfer roller 4, does not induce a fatal damage inhibiting the subsequent use of the apparatus such as the fixing film breakage as in the case of entry into the fixing nip portion H, but still may provide the surface of the photosensitive drum with a scratch, which may undesirably appear depending on its position and size, as an apparent image defect on the recording material after printing.

In consideration of such situation, the present embodiment immediately interrupts the conveying of the recording material by detecting the metallic foreign object 85 prior to the entry thereof into the transfer nip N, thereby preventing the entry of the foreign object 85 into the transfer nip portion N. More specifically, the present embodiment pinches and conveys, prior to the transfer step, a recording material P of a volume resistivity of $10^{11}$-$10^{14}$ Ω·cm bearing a metallic foreign object of a volume resistivity of 10 Ω·cm or less by paired rollers 18 of a medium resistance with a volume resistivity of $10^{6}$-$10^{10}$ Ω·cm, and detects the foreign object based on the difference in the electrical resistance between the recording material and the foreign object 85.

The paired rollers 18 are basically constructed in the same manner as the transfer roller 4 explained above, and each roller 18 is formed by a rubber roller of a medium resistance, constituted of a metal core of iron or stainless steel, and thereon an elastic layer of a solid or foamed rubber material, such as EPDM, silicone rubber, NBR or urethane rubber. Thus, the roller 18 is a conductive member. The roller 18 has a hardness of 25-70° (Asker C hardness under a total load of 9.8 N (1 kg)), and the elastic layer is formed by a primary vulcanization and a secondary vulcanization, followed by a surface polishing to an external shape of a desired dimension. For the voltage applying source 86, the above-explained transfer high-voltage source 23 is utilized.

FIGS. 8A and 8B show flow charts of the metallic foreign object detection in the present embodiment.

At first, when the power supply of the apparatus is turned on, a predetermined voltage is applied by the high-voltage source 86 under rotation of the conductive conveying rollers 18 and a flowing current is measured by the current detecting means 87 to measure a synthetic resistance of the upper and lower conveying rollers 18 (S201-S203).

Then reference is made to a reference table which is prepared in advance by determining the resistance range of the paired conveying rollers 18 in a basically same method as for the transfer roller 4 and by storing it in a memory of the apparatus, and in case the resistance is not within a usable range, an abnormal status is identified to suspend the operation of the apparatus, whereupon the image formation is terminated (S204-S206).

In case the resistance is within the usable range, an optimum transfer voltage, matching the resistance of the transfer roller, is selected, again utilizing the reference table same as that for the transfer roller 4, and memorized until an actual application timing of the transfer voltage (S204, S207).

Then the feeding of the recording material is initiated in response to a print signal, and passing time of the leading end of the recording material P through the paired conductive conveying rollers 18, namely a timing of an anticipated current decrease caused by the recording material P of the high resistance, is stored as t0 in a memory, and a timer is simultaneously activated to measure a period elapsing from t0 (S208-S211).

Then, in case the step 14 (S214) detects an abnormal change in the current flowing in the high-voltage circuit of the paired conductive rollers during the conveying operation after t0 (in the present embodiment, upon detection of a current of 1.5 times or larger of the ordinary current), presence of a foreign object is identified, thus the conveying of the recording material is interrupted at a timing at least before the entry of such foreign object into the fixing nip portion H and a detection timing t2 of the foreign object is stored in a memory (S214, S215).

Steps 212, 213 (S212, S213) and steps 220, 221 (S220, S221) will be explained later.

Then a comparison is made between (t2−t0), obtained by a calculation or from the timer, and an entry time T of the leading end of the recording material calculated in advance from the distance between the paired conductive rollers and the entrance of the transfer nip, and from the recording material conveying speed of the apparatus (S216).

In case of (t2−t0)<T, the presence of a foreign object is detected and the apparatus is stopped to interrupt the conveying of the recording material at a timing before the entry of such foreign object into the transfer nip portion, thereby terminating the image formation (S217).

In case of (t2−t0)≧T the leading end of the recording material has already entered the transfer nip portion N, so that the apparatus is stopped to interrupt the conveying of the recording material before the entry of foreign object into the transfer nip portion N (S218).

In the currently commercial apparatuses, the photosensitive drum constituting the transfer nip portion is either incorporated in a detachable unit which is constructed separately from the main body of the apparatus and which is to be replaced when the service life is exhausted, or assembled in the main body of the apparatus as a highly durable photosensitive drum, having a durability comparable to that of the, main body. In case a recording material remains and stops in the transfer nip portion, in the former case, the photosensitive drum is detached from the main body and the recording material is removed from an aperture thus formed in the main body. In the latter case, the photosensitive drum incorporated in the main body is so constructed that it can be released from the contact state in the transfer nip portion and can be separated from the conveying path of the recording material, so that the recording material can be removed in such separated state.

Therefore, when the apparatus is stopped in such situation, it is usually only necessary to inform the user that a recording material is left in the transfer nip portion and to given an instruction to separate at least the photosensitive drum and to extract the recording material from an aperture thus formed in the main body, and the removing direction of the recording material need not be designated. However, in a case of utilizing a relatively long recording material, which has a metallic foreign object in the trailing end portion, on a compact apparatus with a relatively short distance between the transfer portion and the fixing device, there may result, depending on the combination of the apparatus and the recording material, a situation where, even when the conveying operation of the recording material is interrupted before the trailing end portion thereof enters the transfer portion, the leading end portion of the recording material has already entered the fixing nip portion and is exposed at the exit side thereof.

In such situation where, even though the conveying operation of the recording material is interrupted before the trailing end portion thereof enters the transfer portion, the leading end portion of the recording material has already passed the fixing nip portion, thus being exposed therefrom, and is detected by a sheet discharge sensor, the recording material is more likely to be extracted downstreams along the conveying direction.

In order to avoid such danger, after the apparatus is stopped (S218), the informing means 84 provides the user with an error information and an instruction, for the removal of the recording material, to extract the recording material in the upstream direction along the conveying direction (S219).

Also steps 212, 213 (S212, S213) and steps 220, 221 (S220, S221) may be added to the above-explained sequence.

In case a metallic foreign object 85 is attached to a position of the recording material P, extremely close to the leading end thereof, a slight current decrease in the current flowing in the paired conductive rollers 18 is difficult to detect.

Therefore, a time t0 of entry of the leading end of the recording material into the paired rollers 18 and a passing time t1 of the leading end through the leading end passing detector (registration sensor 19), provided at the downstream side of the paired rollers, are detected, and (t1−t0) is compared with an entry time T2 of the leading end of the recording material into the registration sensor, calculated in advance from the distance between the paired conductive rollers 18 and the registration sensor 19 and from the recording material conveying speed of the apparatus (S12, S13). The registration sensor 19, serving as a leading end detecting device for detecting the leading end of the recording material, is provided at an upstream side of the transfer roller 4 and at a downstream side of the roller pair 18, in the conveying direction of the recording material.

In case of (t1−t0)<T2, the metallic foreign object 85 is identified to be present in a position very close to the leading end of the recording material. Thus the apparatus is immediately stopped (S220), and the informing means 84 provides the user with an error information and an instruction to remove the recording material by an extraction from the downstream side of the registration sensor (S221).

In case of (t1−t0)≧T2, the process is executed according to the sequence of step 14 (S214) and thereafter.

Also the present embodiment allows, utilizing the conductive roller pair 18 for conveying the recording material, to stop the apparatus before the entry of the metallic foreign object into the transfer nip, thereby preventing damage on the photosensitive drum and the transfer roller.

The above-described embodiment allows, utilizing the basic components in the image forming apparatus without any new component and providing means which detects the electrical resistance of the recording material, to stop the apparatus upon detecting a conductive foreign object such as a staple having an electrical resistance different from that of the recording material, attached to the recording material, thereby preventing failures in the image and in the apparatus. Particularly the present embodiment can prevent a film break phenomenon, which causes a fatal trouble in a fixing device utilizing a fixing film. It is also possible, when necessary, to inform the user of the abnormality and to instruct the removal of the foreign object by an appropriate method.

Embodiment 4

Figure 12:
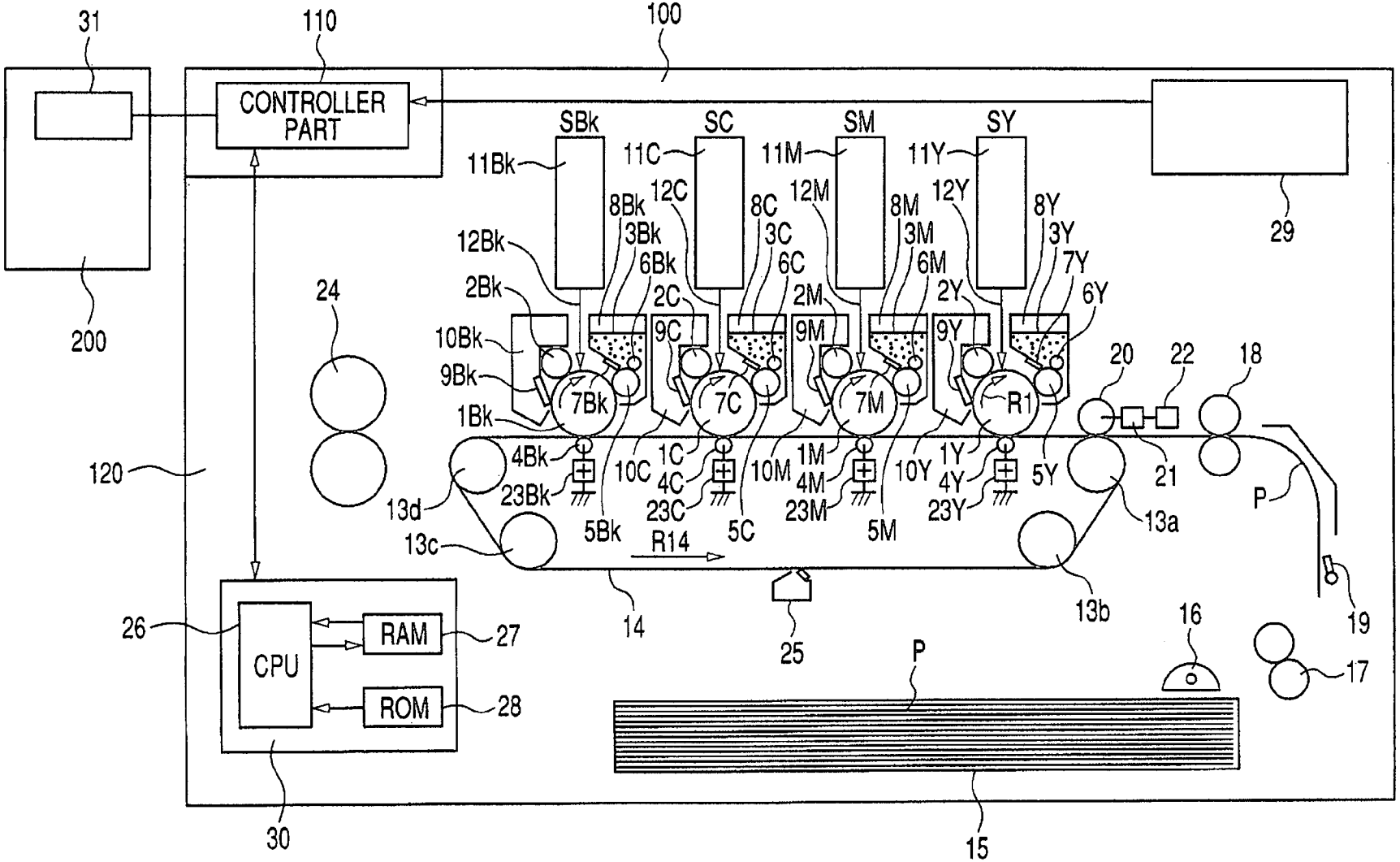
FIG. 12 is a view showing an image forming apparatus constituting another embodiment of the present invention.

FIG. 12 illustrates an image forming apparatus constituting a fourth embodiment of the present invention and formed by a tandem type color image forming apparatus. In the present embodiment, the color image forming apparatus 100 is used as a stand-along type or is connected to a host computer 200 through a network.

The color image forming apparatus 100 includes a controller part 110 and an engine part 120. Image data prepared for example by an application software in the host computer 200 are outputted as print information through a printer driver 31, and supplied to the controller part 110. The controller part 110 executes processes such as a color conversion and a rasterization on thus transmitted image data for supply to the engine part 120.

The engine part 120 will be described in the following.

Referring to FIG. 12, a control device 30 of the engine part 120 is connected with the controller part 110, and controls the operation of the engine part 120 according to an instruction from the controller part 110. The control device 30 is equipped with a CPU 26 for executing an actual control on the engine part 120. The control device 30 is also equipped with a ROM (read-only memory) 28, and a read-write memory RAM 27 serving as a work area for data processing. The ROM 28 stores programs and data required by the CPU 26 for control.

The engine part 120 of the present embodiment is a color image forming engine of so-called tandem type, including plural image forming stations in a linear array.

In the present embodiment, there are provided four image stations SY, SM, SC and SBk respectively for yellow (Y), magenta (M), cyan (C) and black (Bk) colors. These four image stations SY, SM, SC and SBk are arranged in succession along and from an upstream side of a running direction of an endless recording material conveying belt 14, serving as a recording material carrying member (hereinafter called "transfer belt").

The yellow image forming station SY is equipped, as an image bearing member, with a drum-shaped electrophotographic photosensitive member (hereinafter called "photosensitive drum") 1Y. Around the photosensitive drum 1Y and along a rotating direction thereof indicated by an arrow R1, there are provided substantially in succession a charging roller (charging device) 2Y, an exposure device 11Y, a developing device 8Y, a transfer roller (transfer member) 4Y and a cleaning device 10Y.

The photosensitive drum 1Y may be formed, for example, by providing, on a surface of an aluminum cylindrical drum, an organic photoconductor (OPC) layer as a photosensitive layer.

The charging roller 2Y is provided in contact with the surface of the photosensitive drum 1Y, and is given a charging bias by an unillustrated charging bias applying source. Thus the charging roller 2Y uniformly charges the surface of the photosensitive drum 1Y at a predetermined potential of a predetermined polarity. The exposure device 11Y is constituted of a scanner unit which executes, by a polygon mirror, with a laser beam oscillated according to image information, or of an LED array. The exposure device 11Y scan exposes the surface of the photosensitive drum 11Y after charging to eliminate the charge in an exposed area, thereby forming an electrostatic latent image.

The developing device 5Y is provided with a developing sleeve 5Y, an applying roller 6Y and a regulating blade 7Y, and stores non-magnetic one-component developer (non-magnetic toner) 3Y. In the developing device 8Y, the non-magnetic toner is applied by the applying roller 6Y onto the surface of the developing sleeve 5Y and is regulated in thickness by the regulating blade 7Y. The toner, thus regulated in thickness, is carried by the rotation of the developing sleeve 5Y to a developing position opposed to the photosensitive drum 1Y. Then an unillustrated developing bias applying source applies a developing bias to the developing sleeve 5Y, whereby the toner on the developing sleeve 5Y is deposited onto the electrostatic latent image on the photosensitive drum 1Y, thereby developing the latent image into a visible yellow toner image.

The transfer roller 4Y serves to electrostatically transfer the toner image, formed on the photosensitive drum 1Y, onto a recording material P supported on the transfer belt 14. The transfer roller 4Y may be formed for example by covering a metal core with an elastomer such as ethylene propylene-dien ternary copolymer(EPDM), urethane rubber or nitrile-butadiene rubber(NBR) which is regulated to a volume resistivity of about $10^5$-$10^8$ Ω·cm. The transfer roller 4Y is provided inside the transfer belt 14 and presses the transfer belt 14 to the surface of the photosensitive drum 1Y, whereby a transfer nip portion is formed between the photosensitive drum 1Y and the transfer belt 14. The transfer roller 4Y in this embodiment is connected to a transfer bias applying source 23Y, which is a constant current source, but which may also be a constant voltage source.

The cleaning device 10Y is equipped with a cleaning blade 9Y for removing the toner which is not transferred onto the recording material P but remains on the photosensitive drum 1y.

In such yellow image forming station SY, the developing device 8Y is constructed as a developing unit, while the cleaning device 10Y is constructed as a drum unit together with the photosensitive drum 1Y and the charging roller 2Y.

Such developing unit and the drum unit may be constructed as respective process cartridges each detachably mounted in the main body of the image forming apparatus, or may be combined into a single process cartridge.

Other image forming stations SM, SC, SBk for magenta, cyan and black colors are constructed similarly to the yellow image forming station SY and will not, therefore, be explained further. In the magenta, cyan and black image forming stations SM, SC, SBk, components equivalent to those in the yellow image forming station SY will be represented by same numerals, with suffixes M, C or Bk instead of Y.

The transfer belt 14 is supported by four rollers 13*a*, 13*b*, 13*c*, 13*d* and is rotated in a direction indicated by an arrow R14, at a predetermined speed (process speed; 100 mm/s in the present embodiment), thereby conveying the recording material P, supported on the belt surface, in succession to the image forming stations SY, SM, SC and SBk.

The transfer belt 14 is formed by a resinous material of a thickness of 50-300 μm and a volume resistivity of about $10^9$-$10^{16}$ Ω·cm, such as PVdF (polyvinylidene fluoride), polyamide, polyimide, PET (polyethylene terephthalate) or polycarbonate. The transfer belt 14 may also be formed by a rubber material of a thickness of 0.5-2 mm and a volume resistivity of about $10^9$-$10^{16}$ Ω·cm, such as chloroprene rubber, EPDM, NBR or urethane rubber. Also, if necessary, the volume resistivity may be regulated to about $10^7$-$10^{11}$ Ω·cm by dispersing a conductive filler such as carbon, ZnO, $SnO_2$or $TiO_2$.

The recording material P is conveyed by a feed/conveying device, which includes a sheet cassette 15 for containing recording materials P such as plain paper (transfer sheet), a feed roller 16 for feeding the recording material P from the sheet cassette 15, conveying rollers 17, 18 for conveying the fed recording material, and a registration sensor 19 for detecting the leading end of the recording material P.

The registration sensor 19 is constituted of a flag and a photointerruptor, and, when the recording material P pushes the flat to interrupt the photointerruptor, a signal indicating the arrival of the leading end of the recording material P is fetched in the control device 30.

An attraction roller 20, formed by a conductive member and constituting attraction charging means, is used for causing the recording material P, conveyed from the feed/conveying device, to be electrostatically attracted to the surface of the transfer belt 14. The attraction roller 20 is formed by covering a metal core with a conductive elastic member regulated to a volume resistivity of about $10^5$-$10^8$ Ω·cm, such as EPDM, urethane rubber or NBR, then forming thereon an intermediate layer for example of urethane with a thickness of about 200-600 μm, and further providing thereon a surface layer of a thickness of about 250 μm. The surface layer is formed for example with styrene.

The attraction roller 20 is pressurized, on both ends of the metal core, with springs under a linear pressure of 0.04-0.5 N, thus pressed to the roller 13*a* across the transfer belt 14, and is rotated by the movement of the transfer belt 14. In this manner an attraction nip portion is formed between the attraction roller 20 and the roller 13*a*.

In the present embodiment, the attraction roller 20 is connected to an attraction bias applying source 21, which is constituted of a constant voltage source, and is connected to an attraction current measuring circuit 22 for detecting an attraction current. Thus, in a normal state, the recording material P is given an attraction bias of a constant current (10A). Such currently is constantly monitored by the attraction current measuring circuit 22. Such bias of constant current supplies the recording material P with a stable charge, thereby realizing an electrostatic attractive force to the transfer belt.

At a further downstream-side of the roller 13*d* which is provided at the most downstream side of the transfer belt 14, there is provided a fixing device 24 which fixes the toner image transferred onto the recording material P.

When an image forming operation is initiated in the image forming apparatus of the above-described structure, the photosensitive drums 1Y, 1M, 1C, 1Bk and the transfer belt 14 start to rotate respectively in the directions R1 and R14, at a predetermined process speed. At the same time, the exposure devices 11Y, 11M, 11C, 11Bk are activated. The photosensitive drum 1Y is uniformly charged at the predetermined potential of predetermined polarity by the charging roller 2Y.

On the other hand, the recording material P contained in the sheet cassette 15 is fed by the feed roller 16, and conveyed by the conveying rollers 17, 18 to the attraction roller 20. Then the recording material P is electrostatically attracted to the surface of the transfer belt 14 by the voltage application between the attraction roller 20 and the roller 13*a*.

In this state, on the surface of the photosensitive drum 1Y, an electrostatic latent image is formed according to the image formation by a scanning beam 12Y from the exposure device 11Y, in synchronization with the conveying operation of the recording material P. Upon further rotation of the photosensitive drum 1Y, the electrostatic latent image is developed by toner deposition in the developing device 8Y into a visible yellow toner image. The toner image on the photosensitive drum 1Y is transferred onto the recording material P, conveyed by the transfer belt 14 under attraction thereon, by means of an image forming transfer bias applied from the transfer bias applying source 23Y to the transfer roller 4Y.

Also in the magenta, cyan and black image forming stations SM, SC, SBk, as in the yellow image forming station SY, toner images of respective colors are formed on the respective photosensitive drums 1M, 1C, 1Bk. Then, in synchronization with the conveying operation of the recording material P by the transfer belt 14, the toner images on the photosensitive drums 1M, 1C, 1Bk are transferred in superposition onto the recording material P, whereby a toner image with superposed four colors of yellow, magenta, cyan and black is formed on the recording material P.

The recording material P, bearing the transferred toner image, is separated from the transfer belt 14 and subjected to heat and pressure in the fixing device 24, whereby the toner image is fuse fixed on the surface. In the present embodiment, the fixing device 24 is formed by a heat fixing device of film type.

Figure 13:
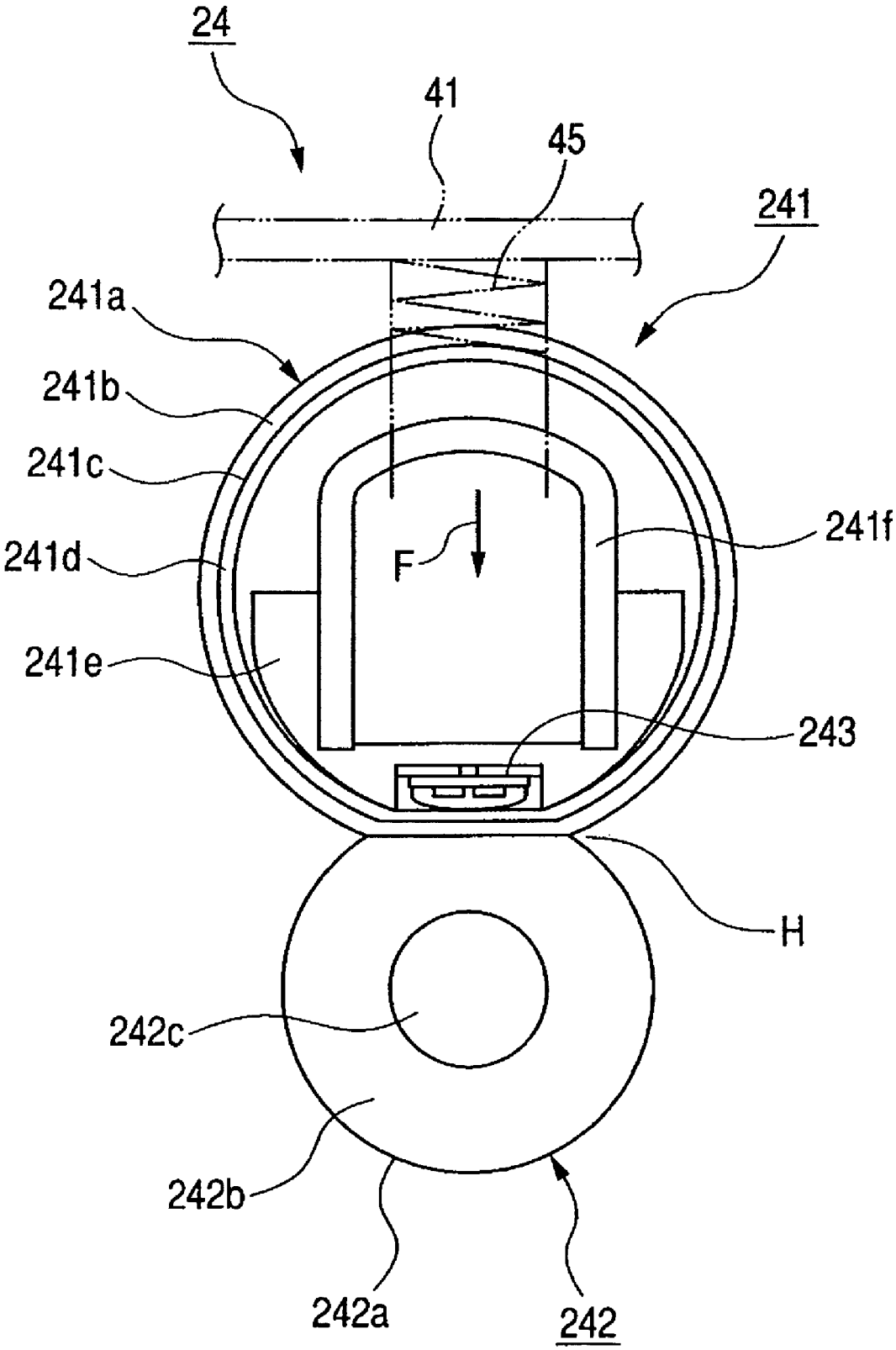
FIG. 13 is a view showing a fixing device of the image forming apparatus.

FIG. 13 shows an embodiment of the film-type heat fixing device 24. In the present embodiment, the film-type heat fixing device 24 is provided with a heating rotary member 241 and a pressurizing rotary member 242, at least one of which is provided with a heat-resistant film.

In the fixing device 24 of the present embodiment, the heating rotary member 241 constitutes a heating unit, provided with a heat-resistant film of a thickness of 300 μm, namely a fixing film 241*a*. The fixing film 241*a* is rendered rotatable along an internally provided film guide 241*e*, and is in a pressurized contact with the pressurizing rotary member, or a pressure roller 242, by a pressure of a releasable pressurizing stay 241*f*.

The fixing film 241*a* is formed by a PI base layer 241*d*, a conductive layer 241*c* for stabilizing the potential, and a surfacial releasing layer 241*b*, and a ceramic heater 243 is provided inside the film at a fixing nip portion H. In the present embodiment, the pressure roller 242 is constituted of a metal core 242*c*, a silicone rubber layer 242*b* and a surfacial releasing layer 242*a*, with an external diameter of 25 mm.

Figure 19:
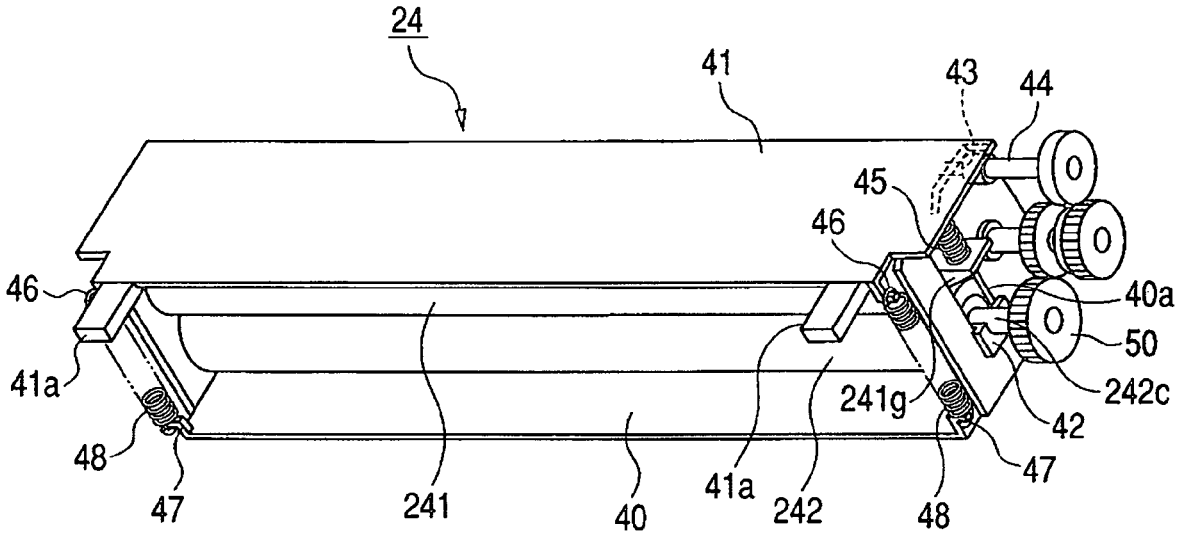
FIG. 19 is a perspective view showing a fixing device.

In the fixing device 24, as will be explained later in more detail with reference to FIGS. 19 and 20, the pressurizing stay 241*f* is pressed by urging means formed for example by a pressure plate 41 and a spring 45, thereby applying a pressure F of 25 kgf in total onto the pressure roller 242. Thus the ceramic heater 243 and the pressure roller 242 constitutes a specified fixing nip portion H across the fixing film 241*a*.

On the other hand, the photosensitive drums 1Y, 1M, 1C, 1Bk after the toner image transfer are subjected to the removal of toner, that has not been transferred to the recording material P but remains on the surface, by the cleaning devices 10Y, 10M, 10C, 10Bk and used in a next image formation.

The color image forming apparatus of the present embodiment has a basic structure and operation as explained above.

Figure 14A:
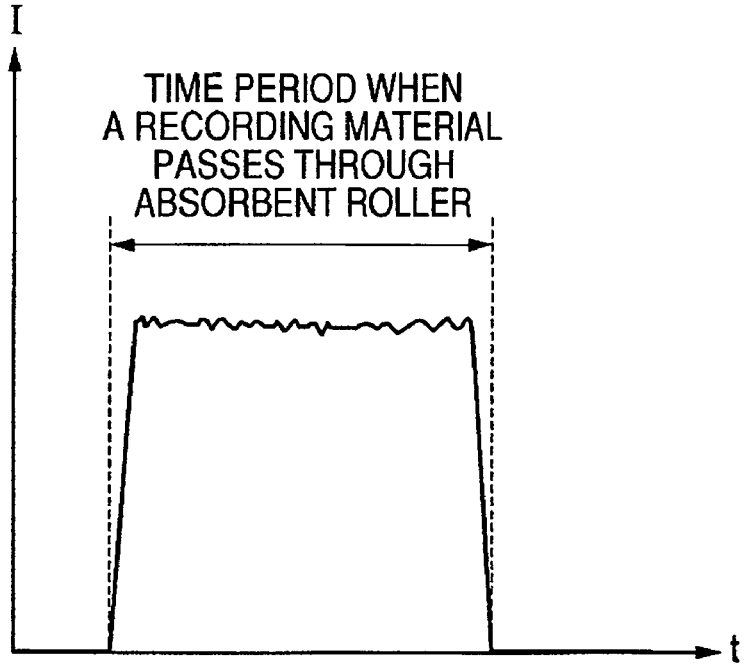
FIG. 14A is a chart showing an absorbent current flowing in an absorbent current measuring device in an activated state.
Figure 14B:
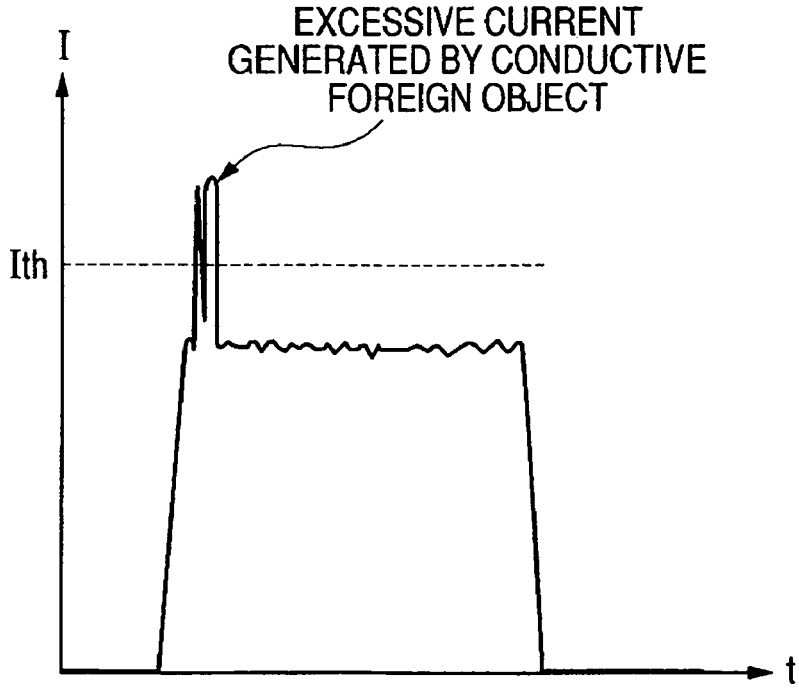
FIG. 14B is a chart showing an absorbent current flowing in an absorbent current measuring device when a conductive foreign object is present on the recording material.

FIG. 14A shows an example of a current profile detected by the attraction current measuring circuit 22 while the recording material P passes through the attraction roller 20 in an activated state, while FIG. 14B shows an example of a current profile detected by the attraction current measuring circuit 22 while the recording material P having a conductive foreign object passes through the attraction roller 20, with the abscissa indicating a time t and the ordinate indicating a current I detected by the attraction current measuring circuit 22.

In a normal state without the abnormality on the recording material P, a stable current flows from the leading end to the trailing end of the recording material P as shown in FIG. 14A. On the other hand, in case the recording material P bears a conductive foreign object 85 such as a staple or a paper clip, a current flows in through such conductive foreign object as shown in FIG. 14B (showing a point exceeding a threshold value (Ith) for judging presence of foreign object). Thus an excessive current is instantaneously detected at this point. The present invention is characterized in utilizing the detection of such excessively current.

In particular, the present embodiment utilizes, for the transfer belt 14, a material of a medium resistance, having a thickness of 50-300 μm and a volume resistivity of about $10^9$-$10^{16}$ Ω·cm, and, also for the attraction roller 20, a material of a medium resistance a volume resistivity of about $10^5$-$10^8$ Ω·cm. On the other hand, the recording material usually has a volume resistivity of about $10^{11}$-$10^{14}$ Ω·cm, and the foreign object has a volume resistivity of 10 Ω·cm or less. Therefore, when a conductive foreign object formed by a material of a low electrical resistance is present on the recording material P, an evident excessive current flows in the attraction roller 20 thereby enabling an easy detection of the conductive foreign object in the recording material.

Figure 15:
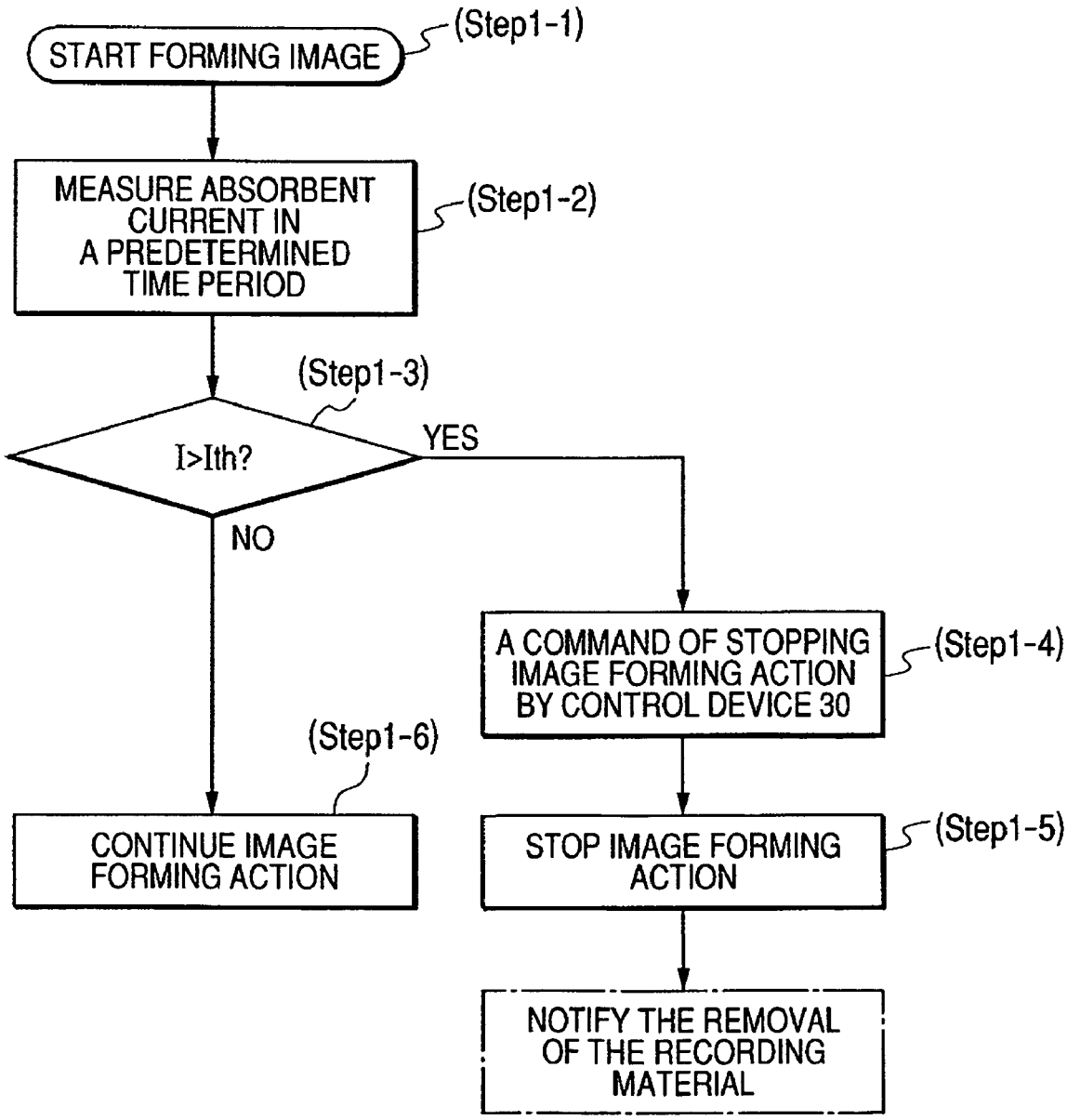
FIG. 15 is a flow chart showing functions of the image forming apparatus.

In the following, the present embodiment will be explained with reference to a flow chart in FIG. 15.

(Step 1-1)

An image forming operation is started in response to a print signal from the control device 30.

(Step 1-2)

A current (I) is measured by the attraction current measuring circuit 22 for a predetermined period (t), which is selected equal to or longer than a time required for the trailing end of the recording material P to pass through the attraction roller 20.

(Step 1-3)

The control device 30 compares the current (I) detected by the attraction current measuring circuit 22, with a predetermined threshold value (Ith). In case of YES (I>Ith), namely in case the recording material P is identified to contain a conductive foreign object, the sequence jumps to (step 1-4). In case of NO (I≦Ith), namely in case the recording material P is identified not to contain a conductive foreign object, the sequence jumps to (step 1-6).

(Step 1-4)

The control device 30 issues a stop command for the image forming operation.

(Step 1-5)

The image forming operation is terminated. If necessary, the user may be informed of the abnormality, and may be requested to remove the recording material having the foreign object by an appropriate method.

(Step 1-6)

The image forming operation is continued.

As explained in the foregoing, the current flowing in the attraction roller 20 in the image forming operation is monitored, and is compared with a predetermined threshold value, thereby detecting whether the recording material contains a conductive foreign object. In case a foreign object is present, the image forming operation is terminated, thereby preventing the film 241 of the fixing device 24 from being damaged by the foreign object.

Thus, the present embodiment can achieve a foreign object detection by a simple configuration of detecting the current amount in the attraction roller. Also the present embodiment, not requiring a new device addition to the image forming apparatus, allows to execute the foreign object detection in the existing structure of the apparatus without a cost increase, thereby preventing failures in the image and in the apparatus.

Embodiment 5

In the following, there will be explained a fifth embodiment of the image forming apparatus of present invention. The image forming apparatus of the present embodiment can be realized by that of Embodiment 4 explained in. FIG. 12, so that the entire constitution of the image forming apparatus will not be explained further.

In case the recording material P bears a conductive foreign object, the damage in the fixing device 24 can be prevented by interrupting the image forming operation before the conductive foreign object reaches the fixing device.

For this purpose, the present embodiment is based on Embodiment 4 and is characterized in defining a time for terminating the image forming operation.

When an image forming operation is initiated in response to a print signal from the control device 30, the feed/conveying device initiates a feed/conveying operation for the recording material P. A control is started from a time (t0) at which the registration sensor detects the arrival of the leading end of the recording material P.

For the purpose of simplicity, the process speed is represented as V (mm/sec).

Figure 16:
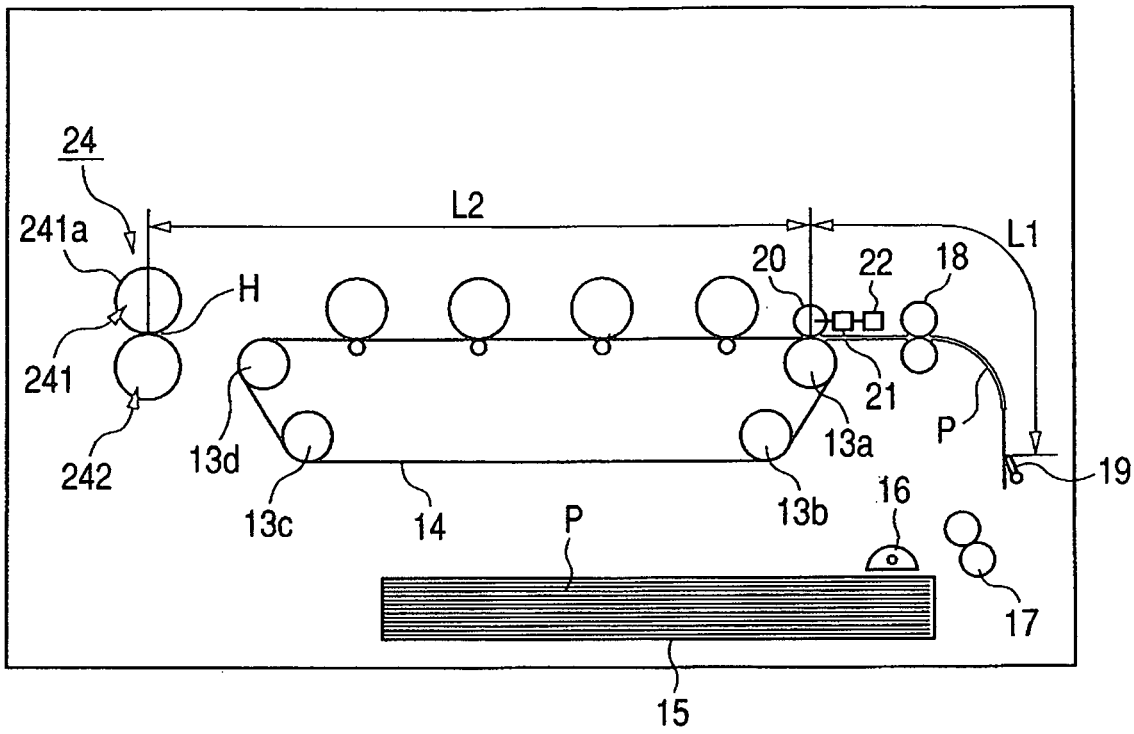
FIG. 16 is a view showing a schematic configuration of an image forming apparatus constituting another embodiment of the present invention.

FIG. 16 is a cross sectional view, showing a principal part only of the image forming apparatus of the present embodiment, shown in FIG. 12.

As shown in FIG. 16, a distance between the registration sensor 19 and the attraction roller 20 is defined as L1, and a distance from the attraction roller to a fixing nip portion H where the fixing film 241*a* and the pressure roller 242 are in mutual contact in the fixing device 24 is defined as L2. The attraction current measuring circuit 22 executes the current detection from t0 to a time t1 when the trailing end of the recording material P passes the position of the attraction roller 20 (t1=(Lp+L1)/V: Lp being length of recording material P).

Figure 17:
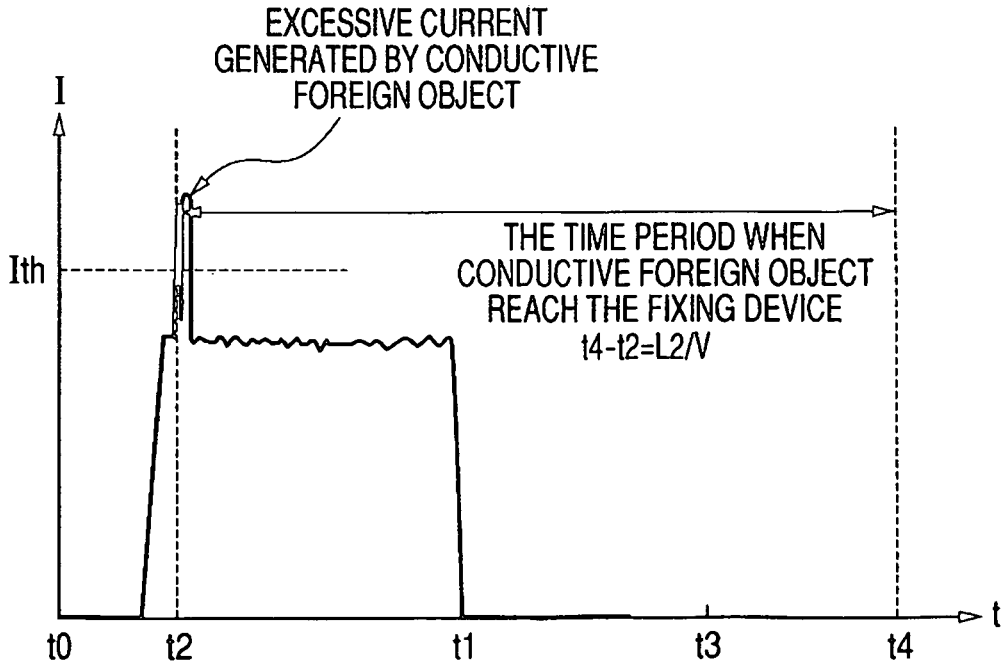
FIG. 17 is a chart showing an absorbent current and a control timing.

FIG. 17 shows, in case the recording material P bears a conductive foreign object, an attraction current as a function of time until the conductive foreign object on the recording material reaches the fixing device 24.

Following relations stand for a time t2 at which the attraction current measuring circuit 22 detects a current (I) exceeding an attraction current threshold value (Ith), a time t3 at which the control device 30 interrupts the image forming operation, and a time t4 at which the conductive foreign object reaches the fixing device 24:

$$(t3-t2)<L2/V+\gamma,\ (\gamma\geqq 0); \qquad \text{relation 1}$$

$$(t3-t2)<(t4-t2)\ (\text{thus } t3<t4). \qquad \text{relation 2}$$

Though the relations 1 and 2 have a similar meaning, but the relation 2 indicates an absolute condition defining that the operation of the image forming apparatus is to be terminated before the conductive foreign object reaches the fixing device 24.

γis a value specific to the image forming apparatus, and is defined by a time difference from an image forming operation stop command issued by the control device 30 to a time at which the image forming apparatus terminates its function. Such γ has to be set, because driving devices employed in an image forming apparatus require a certain time to a complete stop after the power is terminated.

Figure 18:
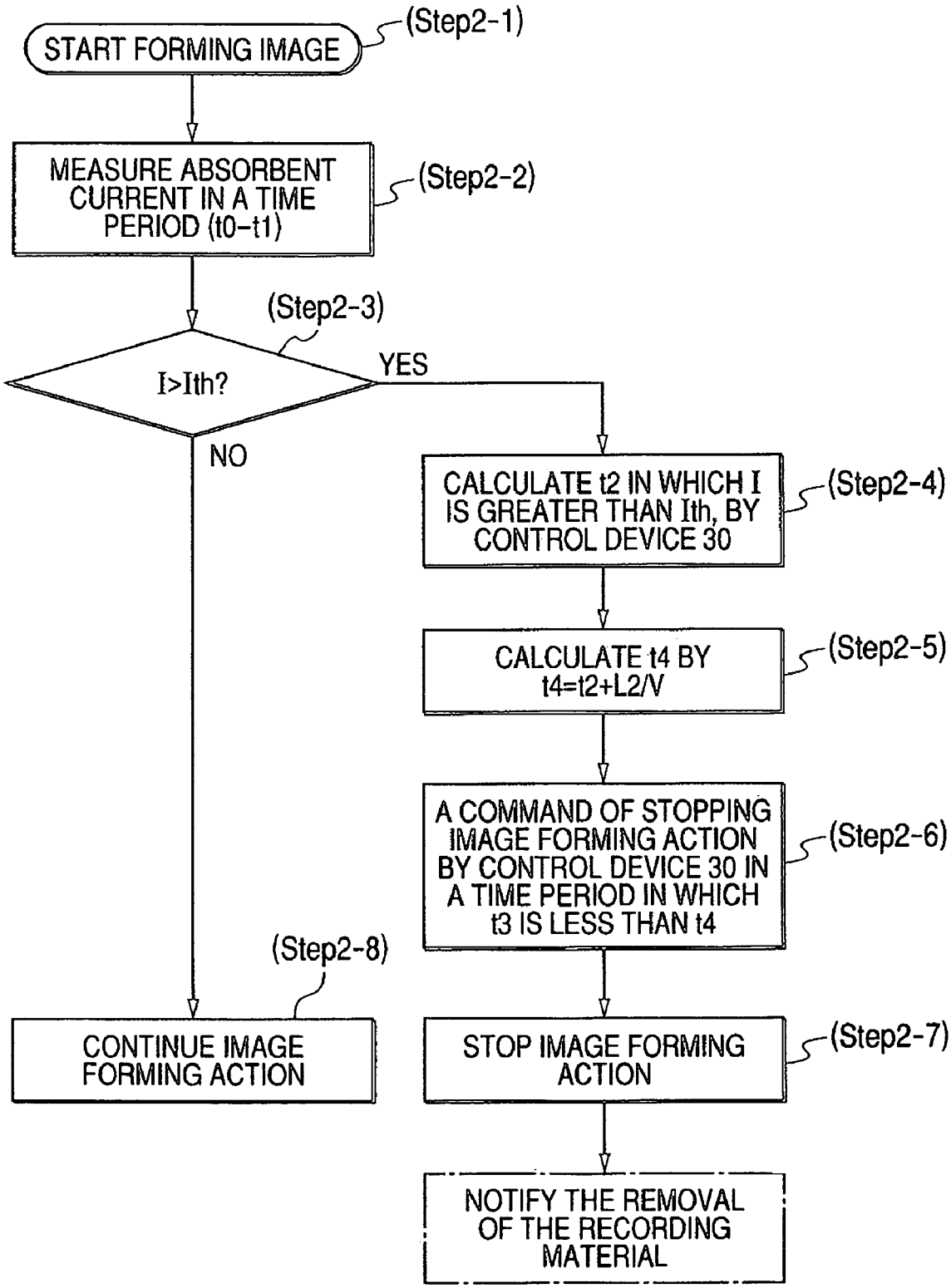
FIG. 18 is a flow chart showing functions of the image forming apparatus.

The above-described operations will be explained further with reference to a flow chart shown in FIG. 18.

(Step 2-1)

An image forming operation is started in response to a print signal from the control device 30.

(Step 2-2)

A current (I) is measured by the attraction current measuring circuit 22 during a period (t0-t1).

(Step 2-3)

The control device 30 compares the current (I) detected by the attraction current measuring circuit 22, with a predetermined threshold value (Ith). In case of YES (I>Ith),namely in case the recording material P is identified to contain a conductive foreign object, the sequence jumps to (step 2-4) In case of NO (I≦Ith), namely in case the recording material P is identified not to contain a conductive foreign object, the sequence jumps to (step 2-8).

(Step 2-4)

The control device 30 calculates a time t2 when a condition I>Ith is met.

(Step 2-5)

t4 is calculated from a formula:

$$t4=t2+L2/V$$

(Step 2-6)

The control device 30 issues a stop command for terminating the image forming operation at a time t3 satisfying a condition t3<t4. The time t3 can be determined based on the time t4 determined in the(step 2-5), and the relation 1.

(Step 2-7)

The image forming operation is terminated. If necessary the user may be informed of the abnormality, and may be requested to remove the recording material having the foreign object by an appropriate method.

(Step 2-8)

The image forming operation is continued.

As explained in the foregoing, the current flowing in the attraction roller 20 in the image forming operation is monitored, and is compared with a predetermined threshold value, thereby detecting whether the recording material contains a conductive foreign object. In case a foreign object is present, the image forming operation is terminated before the foreign object reaches the fixing device, thereby preventing the film 241 of the fixing device 24 from being damaged by the foreign object. Such foreign object prevention can be realized by the existing constitution of the apparatus, without requiring a newly added device and thus without an increase in the cost.

Embodiment 6

In the following, there will be explained a sixth embodiment of the image forming apparatus of present invention. The image forming apparatus of the present embodiment can be realized by that of Embodiment 4 explained in FIG. 12, so that the entire constitution of the image forming apparatus will not be explained further.

The present embodiment is featured in that the fixing device 24 of the structure shown in FIG. 13 is provided with a mechanism for regulating the pressure of the fixing device 24. Thus, when the recording material P bears a conductive foreign object, the pressure of the fixing device 24 is released before the conductive foreign object reaches the fixing device 24, thereby avoiding the damage on the fixing device 24.

In case the recording material P includes a conductive foreign object, it is conceivable, instead of interrupting the image forming operation, to execute a process of discharging the recording material to the exterior of the image forming apparatus. Such discharge to the exterior of the image forming apparatus allows the user to continue the next image forming operation. In such operation, the pressure of the fixing device 24 may be released as far as possible, thereby alleviating the damage on the fixing device 24 by the conductive foreign object of the recording material P.

As explained above, the image forming apparatus of the present embodiment has a structure as shown in FIG. 12.

The pressure release in the fixing device 24 may be realized, for example, by a structure disclosed in Japanese Patent Application Laid-open No. H09-212030.

More specifically, as shown in. FIGS. 19 and 20, the fixing device 24 is equipped with a frame 40 and a pressure plate 41 articulated thereto. The articulation of the pressure plate 41 can be realized by fitting a shaft 44 thereon in a loose hole 43 provided in the frame 40.

Also a bearing 42 provided in an elongated hole 40*a* in the frame 40 supports the pressure roller 242, and the heating unit 241 is provided in a contacting position therewith.

In the heating unit 241, portions on both ends of the pressurizing stay 241*f* acting on the film guide 241*e* and protruding to the elongated holes 40*a* of the frame 40 constitute spring receiving part 241*g*. Such spring receiving part is rendered slidable in the elongated hole 40*a*, and a spring 45 is mounted between the spring receiving part 241*g* and the pressure plate 41.

As the pressure plate 41 is maintained in a closed position by a spring 48 supported by hooks 46, 47 on the frame 40 and the pressure plate 41, the spring 45 causes, through the spring receiving part 241*g*, the heating unit 241 to be pressed to the pressure roller 242.

The fixing device is driven by a gear, provided at an end of the metal core 242*c* of the pressure roller 242, and driven by an unillustrated driving source.

Figure 20:
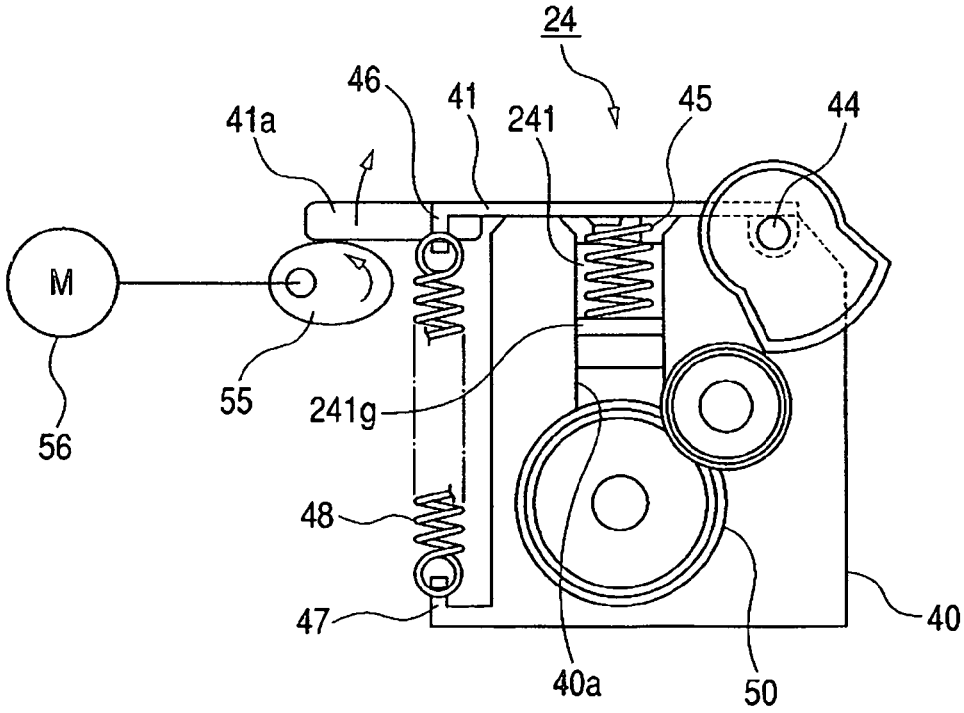
FIG. 20 is a lateral view of the fixing device shown in FIG. 19.

In the present embodiment, a lever 41*a* integrally formed on the other end of the pressure, plate 41 engages with a cam 55 as shown in FIG. 20. The cam 55 is rotated in a direction as indicated by an arrow, by drive means 56 such as an electric motor. Thus the lever 41*a* and the pressure plate 41 rotates about a supporting shaft 44 in a direction indicated by an arrow, namely clockwise in FIG. 20, thereby releasing the pressure on the film guide 241*e*. Thus the pressure of the heating unit 241, on the pressure roller 242, can be released.

The pressure release in the present embodiment means that a load of 25 kgf, urged between the heating unit 241 constituting the fixing film unit and the pressure roller 242, is reduced to about 0 kgf. Such pressure release can be executed by a mechanical release by a pressure releasing mechanism, linked with a rotational displacement of the cam 55 based on a control signal from the control device 30.

Thus, in the image forming apparatus of the present embodiment, based on a pressure release control signal for the fixing device 24 from the control device 30, the driving motor 56 and the cam 55 of the pressure releasing mechanism are activated to release the pressure between the fixing film unit 241 or the fixing film 241*a* and the pressure roller 242.

In the present embodiment, though the conductive foreign object of the recording material P passes through the fixing device 24, the pressure of the fixing device 24 is brought to about 0 kgf, so that the foreign object only applies a very small load on the fixing device 24 and scarcely affect the fixing film. Also an improvement in the usability can be attained as the operation of the image forming apparatus can be continued.

Figure 21:
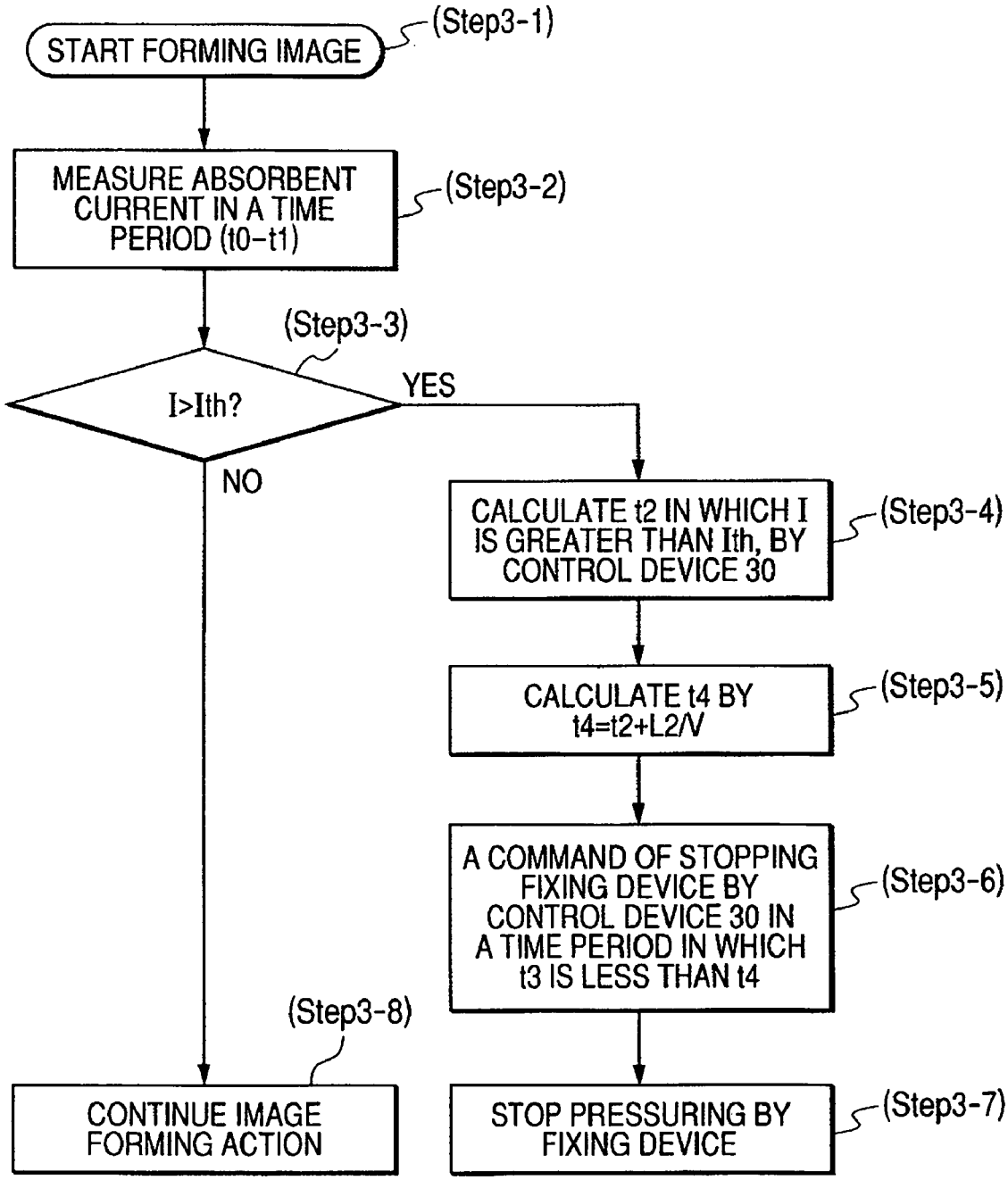
FIG. 21 is a flow chart showing functions of the image forming apparatus.

The above-described operations will be explained further with reference to a flow chart shown in FIG. 21.

(Step 3-1)

An image forming operation is started in response to a print signal from the control device 30.

(Step 3-2)

A current (I) is measured by the attraction current measuring circuit 22 during a period (t0-t1).

(Step 3-3)

The control device.30 compares the current (I) detected by the attraction current measuring circuit 22, with a predetermined threshold value (Ith). In case of YES (I>Ith), namely in case the recording material P is identified to contain a conductive foreign object, the sequence jumps to (step 3-4). In case of NO (I≦Ith), namely in case the recording material P is identified not to contain a conductive foreign object, the sequence jumps to (step 3-8).

(Step 3-4)

The control device 30 calculates a time t2 when a condition I>Ith is met.

(Step 3-5)

t4 is calculated from a formula:

$$t4=t2+L2/V$$

(Step 3-6)

The control device 30 issues a stop command for terminating the image forming operation at a time t3 satisfying a condition t3<t4. The time t3 can be determined based on the time t4 determined in the (step 3-5), and the relation 1.

(Step 3-7)

The pressure of the fixing device 24 is released. Thus the recording, material P, including the conductive foreign object, passes through the fixing device 24 in a pressure released state.

(Step 3-8)

The image forming operation is continued.

In the foregoing, there have been explained operations until the recording material P including the conductive foreign object passes the fixing device 24.

After the recording material P including the conductive foreign object has passed the fixing device 24, a next image forming operation may naturally be continued by returning the fixing device 24 to the normal pressurized state.

As explained in the foregoing, the current flowing in the attraction roller 20 in the image forming operation is monitored, and is compared with a predetermined threshold value, thereby detecting whether the recording material contains a conductive foreign object. In case a foreign object is present, the pressure of the fixing device is released, and the recording material having the foreign object is passed in such state. It is thus possible to prevent damaging the film 241*a* of the fixing device 24 by the foreign object on the recording material. Such process can be realized by the existing constitution of the apparatus, without requiring a newly added device and thus without an increase in the cost.

As explained in the foregoing, the present invention allows to detect a conductive foreign object such as a staple, having a resistance different from that of the recording material, attached to the recording material utilizing the basic components of the image forming apparatus without requiring addition of any new component. It also allows to prevent damage on the fixing device, based on the result of such detection, by interrupting the operation of the apparatus or by releasing the pressure of the fixing device. Also, in necessary, the user may be informed of the abnormality, and may be requested to remove the recording material having the foreign object by an appropriate method thereby preventing failures in the image and in the apparatus. In particular, the present invention can prevent a film break phenomenon, which causes a fatal trouble in a fixing device utilizing a fixing film.

In the foregoing, the present invention has been explained by embodiments thereof, but the present invention is not limited at all by such embodiments and is subject to any and all modifications within the scope of the technical concept of the present invention.

This application claims priority from Japanese Patent Application Nos. 2005-132311 filed Apr. 28, 2005 and 2005-253932 filed Sep. 1, 2005, which are hereby/incorporated by reference herein.

What is claimed is:

1. An image forming apparatus comprising:

an image bearing member on which a toner image is formed;

a transfer member that forms a transfer nip portion with said image bearing member, wherein said transfer member transfers the toner image formed on said image bearing member onto a recording material by applying a voltage into said transfer member;

a fixing device that fixes the toner image transferred onto the recording material, on the recording material, said fixing device having a heater, a film and a roller that forms a fixing nip portion with the heater through the film, wherein the film contacts a recording material at the fixing nip portion;

a current detecting device that detects a current flowing in said transfer member, when the recording material passes through the transfer nip portion;

a judgment device for judging, based on an output from said current detecting device, whether or not a conductive foreign object is present on the recording material;

a leading edge detecting device that is provided at an upstream side of said transfer member with regard to a conveyance direction of the recording material and detects a leading edge of a recording material; and a controller that controls said image forming apparatus, wherein when t1 denotes a timing to detect the leading edge of a recording material by said leading edge detecting device, t2 denotes a timing to detect a conductive foreign object by said current detecting device and T denotes a time in which a recording material passes through the nip portion between the leading edge detecting device and said fixing nip portion, if (t2−t1) is less than T, said controller stops conveying a recording material before the leading edge of the recording material comes into said fixing nip portion, and if (t2−t1) is equal to or more than T, said controller stops conveying a recording material and notifies a user that the recording material is to be removed in an upstream direction of said fixing device with regard to the conveyance direction of the recording material.

2. An image forming apparatus according to claim 1, wherein said transfer member has a volume resistivity of $1\times10^{6}$ to $1\times10^{10}$ Ω·cm.

3. An image forming apparatus according to claim 1, wherein said fixing device includes a pressure device to obtain a pressure for pinching the recording material and a pressure release device to release the pressure applied by said pressure device, wherein when said judgment device judges a presence of a conductive foreign object on the recording material, in a case where (t2−t1) is equal to or more than T, the pressure release device releases the pressure.

* * * * *